US008292836B2

(12) United States Patent
Matsuoka et al.

(10) Patent No.: US 8,292,836 B2
(45) Date of Patent: Oct. 23, 2012

(54) WALKING ASSISTANCE DEVICE AND CONTROLLER FOR THE SAME

(75) Inventors: Yoshihisa Matsuoka, Tochigi (JP); Yasushi Ikeuchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 419 days.

(21) Appl. No.: 12/638,384

(22) Filed: Dec. 15, 2009

(65) Prior Publication Data

US 2010/0152630 A1 Jun. 17, 2010

(30) Foreign Application Priority Data

Dec. 17, 2008 (JP) ..... 2008-321022

(51) Int. Cl.
*A61H 3/00* (2006.01)

(52) U.S. Cl. ..... 601/5; 601/34; 601/35

(58) Field of Classification Search ..... 601/5, 34, 601/35

See application file for complete search history.

(56) References Cited

U.S. PATENT DOCUMENTS

2006/0270951 A1* 11/2006 Ikeuchi ..... 601/5

FOREIGN PATENT DOCUMENTS

JP 2007-029633 2/2007
JP 2008253539 10/2008

* cited by examiner

*Primary Examiner* — Laura Bouchelle
(74) *Attorney, Agent, or Firm* — Rankin, Hill & Clark LLP

(57) ABSTRACT

A walking assistance device is capable of preventing a load transmit portion thereof from falling due to gravity when the operation of an actuator of the walking assistance device is stopped. A leg link is provided with an elastic member that imparts, to a third joint, an urging torque for restraining the flexion degree of the leg link from changing from a predetermined first flexion degree due to the gravity acting on the walking assistance device in a reference state wherein a foot-worn portion connected to the load transmit portion through the leg link is in contact with a ground and the flexion degree of the leg link at the third joint is the first flexion degree.

8 Claims, 13 Drawing Sheets

WALKING ASSISTANCE DEVICE AND CONTROLLER FOR THE SAME

BACKGROUND OF THE INVENTION

1. Field of the Invention

The present invention relates to a walking assistance device which assists leg motion during walking or the like of a user (person) and a controller which controls the operation of the walking assistance device.

2. Description of the Related Art

Hitherto, as this type of walking assistance device, Japanese Patent Application Laid-Open No. 2007-29633 (hereinafter referred to as "patent document 1"), for example, discloses one proposed by the present applicant. This walking assistance device has a load transmit portion on which a user sits astride, foot-worn portions to be attached to the feet of the user, and leg links which connect the foot-worn portions to the load transmit portion. In this case, each of the leg links is constructed of an upper link member extended from the load transmit portion through the intermediary of a first joint, a lower link member extended from the foot-worn portion through the intermediary of a second joint, and a third joint which bendably connects the upper link member and the lower link member. Further, the third joint is driven by a drive source (actuator) mounted on the upper link member. The third joint is driven to cause load for supporting a part of the weight of the user (an upward translational force) to act on the body trunk of the user through the intermediary of the load transmit portion. Thus, a burden on a leg or legs of the user is reduced.

According to the walking assistance device disclosed in the aforesaid patent document 1, when a power source of an electric motor or the like serving as an actuator, is turned off while the load transmit portion is still disposed under the crotch of a user at the time of, for example, removing the walking assistance device from the user, the load transmit portion rapidly freely falls by gravity acting on the walking assistance device unless the user or an attendant or the like manually supports the load transmit portion. Further, there has been a danger in that an impact from the free fall damages the joints or the like of leg links and the load transmit portion or the like bumps against another object and breaks the object.

Further, in the walking assistance device disclosed in patent document 1, it is considered desirable in effectively reducing a burden on a leg or legs of the user to increase load to be applied to the user from the load transmit portion particularly in a state wherein the user has his/her knee or knees bent relatively deeply.

However, in the conventional walking assistance device, increasing the load to be applied to the user from the load transmit portion requires a relatively large driving force of an actuator. This has inconveniently resulted in an increased size or an increased weight of the actuator, making it difficult to achieve a smaller size and a reduced weight of the walking assistance device. In addition, there has been another inconvenience in that the actuator requires a relatively large driving force, leading to increased energy consumption by the actuator.

SUMMARY OF THE INVENTION

The present invention has been made in view of the background described above, and an object of the present invention is to provide a walking assistance device capable of preventing a load transmit portion from falling due to gravity even when the operation of an actuator for driving the joints of leg links is stopped. Another object is to provide a walking assistance device capable of reducing the size and the weight of an actuator or reducing energy consumption. Still another object is to provide a controller suited for controlling the operation of the walking assistance device.

To this end, a walking assistance device in accordance with the present invention has a load transmit portion which transmits load for supporting a part of the weight of a user to a body trunk of the user, a foot-worn portion which is attached to a foot of the user, a leg link which connects the foot-worn portion to the load transmit portion, and a drive mechanism which includes an actuator and transmits motive power output from the actuator to a joint provided in the leg link so as to drive the joint, wherein the leg link is provided with an elastic member for imparting, to the joint of the leg link, an urging force for restraining the posture of the leg link from changing from a predetermined posture due to gravity acting on the walking assistance device in a reference state wherein at least the foot-worn portion is in contact with a ground and the posture of the leg link is the predetermined posture (a first aspect of the invention).

According to the first aspect of the invention, in the reference state wherein at least the foot-worn portion is in contact with a ground and the posture of the leg link is a predetermined posture, even when the operation of the actuator is stopped, i.e., even when no motive power is imparted from the actuator to the joint of the leg link, the urging force imparted to the joint of the leg link from the elastic member restrains the posture of the leg link from changing from the predetermined posture due to the gravity acting on the walking assistance device. Thus, stopping the operation of the actuator in the aforesaid reference state makes it possible to prevent the load transmit portion from falling due to gravity. This in turn makes it possible to prevent damage to the walking assistance device.

A further specific mode of the walking assistance device it accordance with the present invention has a load transmit portion which transmits load for supporting a part of the weight of a user to a body trunk of the user, a foot-worn portion to be attached to a foot of the user, a leg link which connects the foot-worn portion to the load transmit portion, the leg link including an upper link member extended from the load transmit portion through the intermediary of a first joint, a lower link member extended from the foot-worn portion through the intermediary of a second joint, and a third joint bendably connecting the upper link member and the lower link member, and a drive mechanism which includes an actuator and transmits the motive power output from the actuator to the third joint so as to drive the third joint, wherein the leg link is provided with an elastic member which imparts, to the third joint, an urging torque for restraining a flexion degree of the leg link from changing from a first flexion degree due to gravity acting on the walking assistance device in a reference state wherein at least the foot-worn portion is in contact with a ground and the flexion degree of the leg link at the third joint is a predetermined first flexion degree (a second aspect of the invention).

According to the second aspect of the invention, the urging torque imparted to the third joint from the elastic member restrains the flexion degree of the leg link from changing from the predetermined first flexion degree caused by the gravity acting on the walking assistance device in the reference state, in which at least the foot-worn portion is in contact with a ground and the flexion degree of the leg link at the third joint is the predetermined first flexion degree, when the operation of the actuator is stopped (in the state wherein the motive power from the actuator is not imparted to the third joint of a leg link). Thus, stopping the operation of the actuator in the reference state makes it possible to prevent the load transmit portion from falling due to gravity. This in turn makes it possible to prevent damage to the walking assistance device.

In order to restrain the flexion degree of the leg link from changing from the first flexion degree by using the urging torque imparted by the elastic member to the third joint in the reference state, at least the urging torque in the reference state is to be set to counterbalance with a torque acting on the third joint due to the gravity acting on the walking assistance device. In this case, the magnitude of the torque acting on the third joint due to the gravity does not have to exactly agree with the aforesaid urging torque, as long as the difference between the torques is sufficiently small. This is because, between an upper link member and a lower link member, a frictional force of a certain magnitude can be generally produced at the third joint.

In the second aspect of the invention, the flexion degree of the leg link can be generally changed in a predetermined variable range including the flexion degree in a state wherein a user is in an upright posture. In this case, the first flexion degree is preferably a flexion degree which is closer to the flexion degree in the state wherein the user is in the upright posture than a maximum flexion degree in the variable range (a third aspect of the invention).

In the second aspect of the invention, the phrase "the flexion degree which is closer to the flexion degree in the state wherein the user is in the upright posture" includes a flexion degree that agrees with the flexion degree in the upright posture state.

According to the second aspect of the invention, the posture state of the user corresponding to the reference state becomes the upright posture state or a state close thereto, so that the operation of the actuator can be stopped without causing the load transmit portion to fall in a state wherein the user is in a relatively relaxed posture (a state wherein there is no need to generate a very large force at a leg of the user) after using the walking assistance device. Hence, the walking assistance device can be easily removed from the user without requiring much labor of the user or an attendant.

In the third aspect of the invention, the urging torque to be imparted to the third joint by the elastic member is preferably set such that the resultant torque of a torque which acts on the third joint due to the gravity acting on the walking assistance device in a state wherein at least the flexion degree of the leg link becomes the maximum flexion degree in the variable range and the aforesaid urging torque becomes a torque in the flexing direction of the leg link (a fourth aspect of the invention).

According to the fourth aspect of the invention, the resultant torque of the torque acting on the third joint due to the gravity acting on the walking assistance device and the urging torque imparted by the elastic member to the third joint becomes the torque in the flexing direction of the leg link in the state wherein the operation of the actuator is stopped with the flexion degree of the leg link being the maximum flexion degree (the leg link being bent to a maximum at the third joint). This makes it possible to steadily maintain the state wherein the flexion degree of the leg link is the maximum flexion degree, that is, the state wherein the leg link is folded to its maximum compactness. Therefore, the walking assistance device can be accommodated in a small storage space when not in use.

In the third or the fourth aspect of the invention, preferably, the urging torque to be imparted by the elastic member to the third joint is set such that the resultant torque of a torque acting on the third joint due to the gravity acting on the walking assistance device and the urging torque becomes a torque in a stretching direction of the leg link in the case where the flexion degree of the leg link is a flexion degree that is larger than a predetermined second flexion degree in the variable range, and the first flexion degree is a flexion degree that is the second flexion degree or less (a fifth aspect of the invention).

More specifically, in general, as the flexion degree of the leg link increases, the torque of the third joint (the torque in the stretching direction of the leg link) required to apply target load to the user from the load transmit portion increases accordingly. Therefore, the torque required to be transmitted to the third joint from the actuator can be decreased by setting the urging torque such that the resultant torque becomes a torque in the stretching direction of the leg link in the case where the flexion degree of the leg link is larger than the predetermined second flexion degree, that is, in the case where the flexion degree of the leg link is relatively large. As a result, the maximum motive power to be output by the actuator can be restrained to be small and therefore the actuator can be made smaller and lighter. Moreover, since the motive power to be output by the actuator can be restrained to be small, the energy consumption of the actuator can be reduced accordingly.

Further, the first flexion degree is a flexion degree of the second flexion degree or less, so that in the case where the flexion degree of the leg link is relatively small, i.e., in the case where the flexion degree of the leg link is close to the flexion degree in the state wherein the user is in the upright posture, the urging torque makes it possible to restrain the flexion degree of the leg link from changing even when the operation of the actuator is stopped. Thus, the operation of the actuator can be stopped without causing the load transmit portion from falling in the state wherein the user is in a relatively relaxed posture (in the state wherein there is no need to generate a very large force at a leg of the user), as explained in relation to the third aspect of the invention.

According to the second to the fifth aspects of the invention, the drive mechanism has, for example, a crank arm secured to the lower link member concentrically with the joint axis of the third joint and a linear-motion actuator, which has a linear-motion output shaft, one end thereof being connected to the crank arm, and which is mounted on the upper link member such that the linear-motion actuator can swing about the axial center of a swing shaft parallel to a joint axis of the third joint. The drive mechanism is constructed so as to convert a translational force output from the linear-motion output shaft of the linear-motion actuator into a rotational driving force for the third joint through the intermediary of the crank arm. In this case, the elastic member is preferably composed of a coil spring that urges the linear-motion output shaft of the linear-motion actuator in the direction of the axial center (a sixth aspect of the invention).

According to the sixth aspect of the invention, the ratio between a translational force output from the linear-motion output shaft of the linear-motion actuator (a translational force imparted to the crank arm from the linear-motion output shaft) and the rotational driving force of the third joint obtained by converting the translational force through the crank arm into the rotational driving force for the third joint changes according to the flexion degree of the leg link. This makes it possible to balance the rotational driving force (urging torque) imparted to the third joint of the leg link by the urging force (translational force) imparted to the linear-motion output shaft by the coil spring and the torque generated in the third joint due to the gravity acting on the walking assistance device in a state wherein the flexion degree of the leg link lies within a certain range. It is possible, therefore, to expand the range of the flexion degree of the leg link wherein the change in the flexion degree of the leg link due to the gravity acting or the walking assistance device can be restrained when the operation of the linear-motion actuator is stopped. In other words, an arbitrary flexion degree of the leg link in the certain range can be set as the first flexion degree. As a result, the range of the flexion degree of the leg link in which the load transmit portion can be prevented from falling when the operation of the linear-motion actuator is stopped is expanded, permitting improved user-friendliness of the walking assistance device.

Further, in the second to the sixth aspects of the invention, the elastic member preferably has a characteristic in which the change rate of an elastic force with respect to a change in an elastic deformation amount thereof changes with the elastic deformation amount (a seventh aspect of the invention).

The seventh aspect of the invention makes it easy to set the characteristic of changes in the urging torque based on the flexion degree of the leg link to an appropriate characteristic.

To be specific, in the sixth aspect of the invention, for example, the coil spring preferably has a characteristic in which the change rate of the elastic force relative to a change in a compression amount of the coil spring differs between a first compression range in which the compression amount is a predetermined value or less and a second compression range in which the compression amount exceeds the predetermined value, and the change rate in the second compression range is larger than the change rate in the first compression range, and the coil spring is provided such that the coil spring is compressed as the linear-motion output shaft is displaced in a direction in which the flexion degree of the leg link increases (an eighth aspect of the invention).

According to the eighth aspect of the invention, a state wherein the urging torque is maintained substantially constant as long as the flexion degree of the leg link is relatively small and when the compression amount of the coil spring lies in the first compression range in which the compression amount is a predetermined value or less. Thus, in the state wherein the flexion degree of the leg link is the second flexion degree, setting the compression amount of the coil spring to be in the first compression range makes it easy to balance the torque acting on the third joint due to the gravity acting on the walking assistance device and the urging torque at an arbitrary flexion degree of the second flexion degree or less. Further, in a state wherein the flexion degree of the leg link is relatively large and the compression amount of the coil spring lies in the second compression range in which the compression amount of the coil spring exceeds a predetermined value, the resultant torque of the urging torque and a torque acting on the third joint due to the gravity acting on the walking assistance device can be easily set to a relatively large torque in the direction in which the leg link stretches.

In the sixth or the eighth aspect of the invention, preferably, the linear-motion actuator is installed at a location adjacent to the first joint of the upper link member and the coil spring is concentrically disposed with the linear-motion output shaft between the linear-motion actuator and the third joint (a ninth aspect of the invention).

According to the ninth aspect of the invention, the coil spring is disposed concentrically with the linear-motion output shaft between the linear-motion actuator and the third joint, so that the coil spring can be disposed not to project from the upper link member. Thus, the assembly combining the coil spring and the drive mechanism can be made smaller.

Further, a controller for a walking assistance device is a controller which controls the operation of the walking assistance device in accordance with the second to the ninth aspects of the invention described above. The controller includes a control object amount measuring device which measures, as an amount to be controlled, a torque imparted to the third joint or a force that specifies the torque, a flexion degree measuring device which measures the flexion degree of the leg link at the third joint, a target value determining device which determines a target value of the control object amount, a feedback manipulated variable determining device which determines the feedback manipulated variable of the actuator by using a feedback control law on the basis of at least the determined target value of the control object amount and the measured value of the control object amount, a feedforward manipulated variable determining device which determines the feedforward manipulated variable of the actuator on the basis of at least the determined target value of the control object amount and the measured value of the flexion degree, and an actuator drive section which operates the actuator on the basis of the resultant manipulated variable of the determined feedback manipulated variable and the determined feedforward manipulated variable, wherein the feedforward manipulated variable includes at least a component which is determined on the basis of the determined target value of the control object amount and a component which is determined such that the component changes depending on the urging torque imparted to the third joint by the elastic member (a tenth aspect of the invention).

According to the tenth aspect of the invention, the operation of the actuator is performed on the basis of the resultant manipulated variable of the feedback manipulated variable and the feedforward manipulated variable. In this case, the feedforward manipulated variable includes the component which is determined on the basis of the determined target value of the determined control object amount and another component which is determined such that the component changes depending on the urging torque imparted to the third joint by the elastic member. Hence, the feedforward manipulated variable can be determined, considering an influence of the urging torque in a feedforward manner. As a result, an undue change in the motive power output from the actuator on the basis of the resultant manipulated variable can be restrained in compensating for an influence that causes the urging torque to change according to the flexion degree of the leg link. Moreover, it is possible to make an actual control object amount measured by the control object amount measuring device promptly follow a target value.

DESCRIPTION OF THE PREFERRED EMBODIMENTS

First Embodiment

A first embodiment of the walking assistance device in accordance with the present invention will be described with reference to FIG. 1 to FIG. 13.

Figure 1:
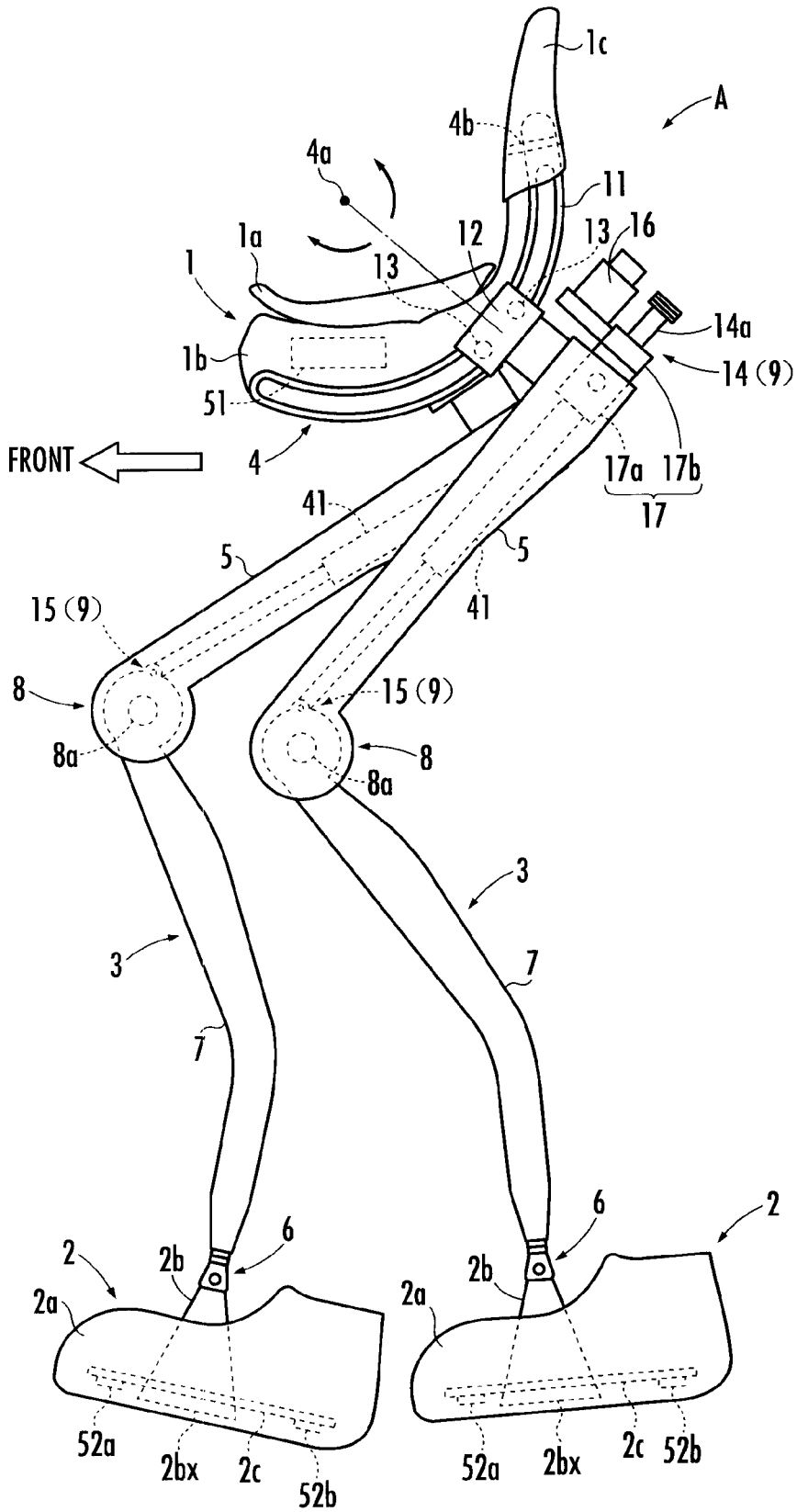
FIG. 1 is a side view illustrating a schematic construction of a walking assistance device according to an embodiment of the present invention.

As illustrated in FIG. 1, a walking assistance device A according to the present embodiment is provided with a seating portion 1 serving as a load transmit portion, a pair of right and left foot-worn portions 2 and 2 to be attached to the feet of individual legs of a user (not shown), and a pair of right and left leg links 3 and 3 which connect the foot-worn portions 2 and 2, respectively, to the seating portion 1. The right and left foot-worn portions 2 and 2 are laterally symmetrical to each other and share the same structure. The right and left leg links 3 and 3 are also laterally symmetrical to each other and share the same structure. In the description of the present embodiment, the lateral direction of the walking assistance device A means the lateral direction of the user having the foot-worn portions 2 and 2 attached to his or her feet (the direction substantially perpendicular to the paper surface in FIG. 1).

Each of the leg links 3 is constituted of an upper link member 5 extended downward from the seating portion 1 via a first joint 4, a lower link member 7 extended upward from the foot-worn portion 2 via a second joint 6, and a third joint 8 which bendably connects the upper link member 5 and the lower link member 7 between the first joint 4 and the second joint 6.

Further, the walking assistance device A has a drive mechanism 9 for driving the third joint 8 for each leg link 3. The drive mechanism 9 of the left leg link 3 and the drive mechanism 9 of the right leg link 3 are laterally symmetrical and share the same structure. Regarding the drive mechanism 9 of the right leg link 3, a part of the drive mechanism 9 in FIG. 1 is omitted for easy understanding of the illustration.

The seating portion 1 is constituted of a saddle-shaped seat 1*a* disposed such that the seat 1*a* is positioned between the proximal ends of the two legs of a user when the user sits thereon astride, a base frame 1*b* attached to the bottom surface of the seat 1*a*, and a hip pad 1*c* attached to the rear end portion of the base frame 1*b*, i.e., the portion that rises upward at the rear of the seat 1*a*.

The first joint 4 of each of the leg links 3 is a joint which has a freedom degree (2 degrees of freedom) of rotation about two joint axes, namely, in the longitudinal direction and the lateral direction. More specifically, each of the first joints 4 has an arcuate guide rail 11 attached to the base frame 1*b* of the seating portion 1. A slider which is secured to the upper end of the upper link member 5 of each of the leg links 3, movably engages the guide rail 11 through the intermediary of a plurality of rollers 13 rotatably attached to the slider 12. This arrangement enables each of the leg links 3 to effect a swing motion in the longitudinal direction (a longitudinal swing-out motion) about the axis of the first joint, taking the lateral axis passing a curvature center 4*a* of the guide rail 11 (more specifically, the axis in the direction perpendicular to a plane that includes the arc of the guide rail 11) as a first joint axis of the first joint 4.

Further, the guide rail 11 is rotatably supported at the rear upper end of the base frame 1*b* of the seating portion 1 through the intermediary of a support shaft 4*b* having the axial center thereof oriented in the longitudinal direction, so that the guide rail 11 is allowed to swing about the axial center of the support shaft 4*b*. This arrangement enables each of the leg links 3 to effect a lateral swing motion (adduction/abduction motion) about a second joint axis of the first joint 4, taking the axial center of the support shaft 4*b* as the second joint axis of the first joint 4. In the present embodiment, the second joint axis of the first joint 4 provides a joint axis common to the right first joint 4 and the left first joint 4.

As described above, the first joint 4 is constructed to allow each of the leg links 3 to effect swing motions about the two joint axes, namely, in the longitudinal direction and the lateral direction.

The degree of the rotational freedom of the first joint is not limited to two. Alternatively, the first joint may be constructed to have, for example, a freedom degree of rotation about three joint axes, i.e., three degrees of freedom. Further alternatively, the first joint may be constructed to have, for example, a freedom degree of rotation about only one joint axis in the lateral direction, i.e., one degree of freedom.

Each of the foot-worn portions 2 has a shoe 2*a* for the user to put on a foot and a connecting member 2*b* projecting upward from inside the shoe 2*a*. Each leg of the user lands on the ground through the shoe 2*a* in a state wherein the leg is a standing leg, i.e., a supporting leg. The lower end of the lower link member 7 of each of the leg links 3 is connected to the connecting member 2*b* via the second joint 6. In this case, the connecting member 2*b* has, as an integral part thereof, a flat-plate-like portion 2*bx* disposed under an insole 2*c* in the shoe 2*a* (between the bottom of the shoe 2*a* and the insole 2*c*). The connecting member 2*h*, including the flat-plate-like portion 2*bx*, is formed of a member having relatively high rigidity such that, when the foot-worn portion 2 is landed, a part of a floor reaction force acting from a floor onto the foot-worn portion 2 (a translational force which is large enough to support the weight combining at least the walking assistance device A and a part of the weight of the user) can be applied to the leg link 3 through the intermediary of the connecting member 2*b* and the second joint 6.

The foot-worn portion 2 may have, for example, slipper-like footwear in place of the shoe 2*a*.

The second joint 6 in the present embodiment is constituted of a free joint, such as a ball joint, and has a freedom degree of rotation about three axes. However, the second joint 6 may alternatively be a joint having a freedom degree of rotation about, for example, two axes in the longitudinal and lateral directions or two axes in the vertical and lateral directions.

The third joint 8 is a joint having a freedom degree of rotation about one axis in the lateral direction and has a support shaft 8*a* rotatably supporting the upper end of the lower link member 7 at the lower end of the upper link member 5. The axial center of the support shaft 8*a* is substantially parallel to the first joint axis of the first joint 4 (the axis in a direction perpendicular to a plane which includes the arc of the guide rail 11). The axial center of the support shaft 8*a* provides the joint axis of the third joint 8, and the lower link member 7 can be relatively rotated about the joint axis with respect to the upper link member 5. This allows the leg link 3 to stretch or bend at the third joint 8.

In order to apply load for supporting a part of the weight of the user sitting on the seating portion 1 (an upward translational force) to the user from the seating portion 1, each of the drive mechanisms 9 imparts a rotational driving force (torque) in the direction in which the leg link 3 stretches to the third joint 8 of the leg link 3 having the foot-worn portion 2 thereof in contact with the ground. The drive mechanism 9 is mounted on the upper link member 5 of the leg link 3 and constituted of a linear-motion actuator 14 having a linear-motion output shaft 14*a* and a motive power transmit mechanism 15 which converts motive power output from the linear-motion output shaft 14*a*, i.e., a translational force in the direction of the axial center of the linear-motion output shaft 14*a*, into a rotational driving force and transmits the rotational driving force to the third joint 8.

Figure 2:
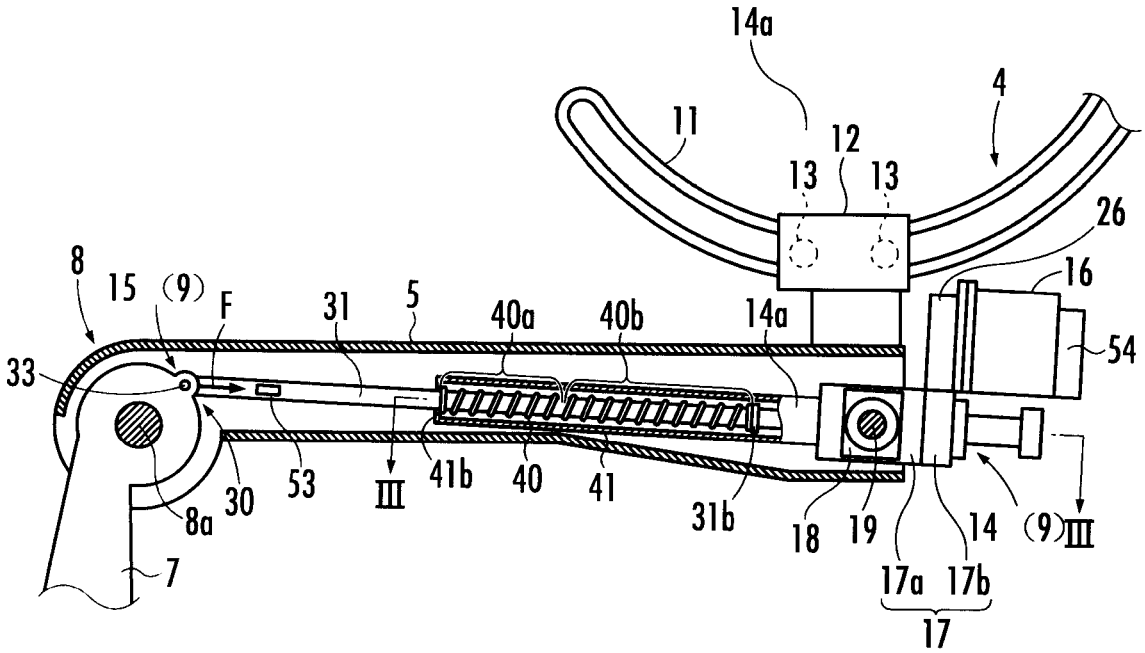
FIG. 2 is a cutaway view of an upper link member of the walking assistance device in FIG. 1.
Figure 3:
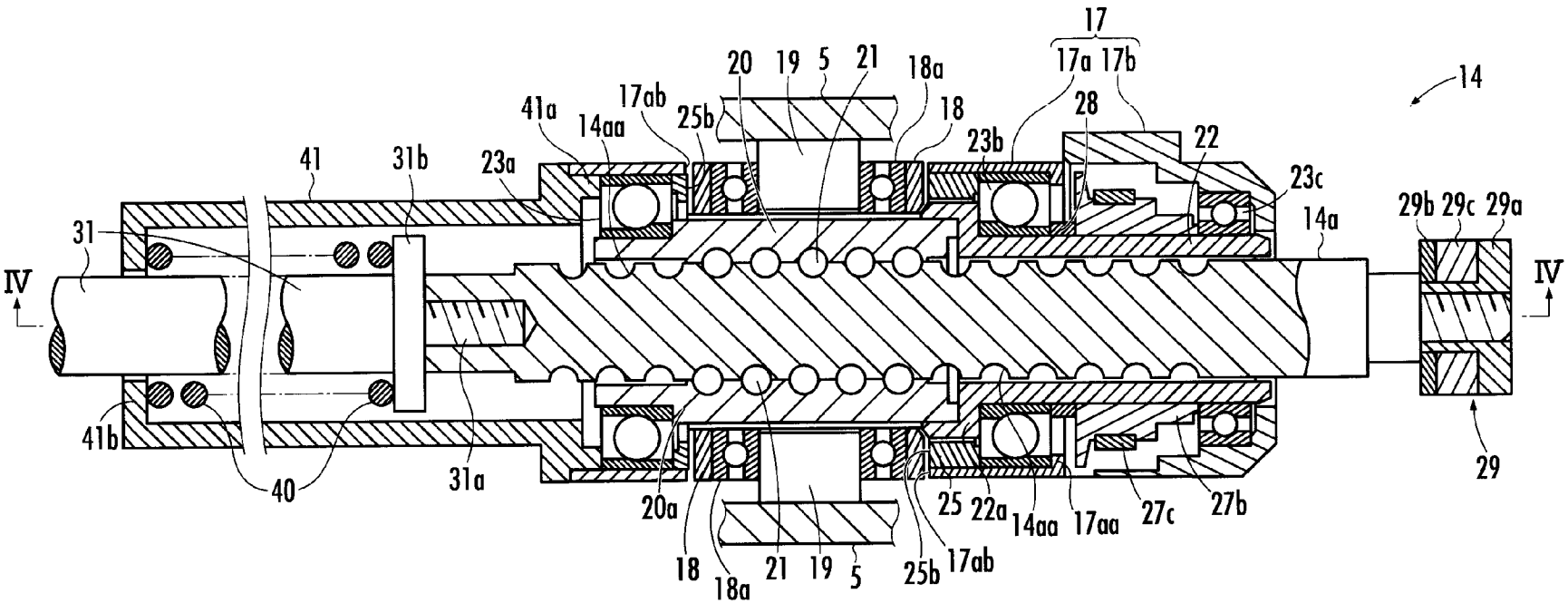
FIG. 3 is a sectional view taken at line in FIG. 2.
Figure 4:
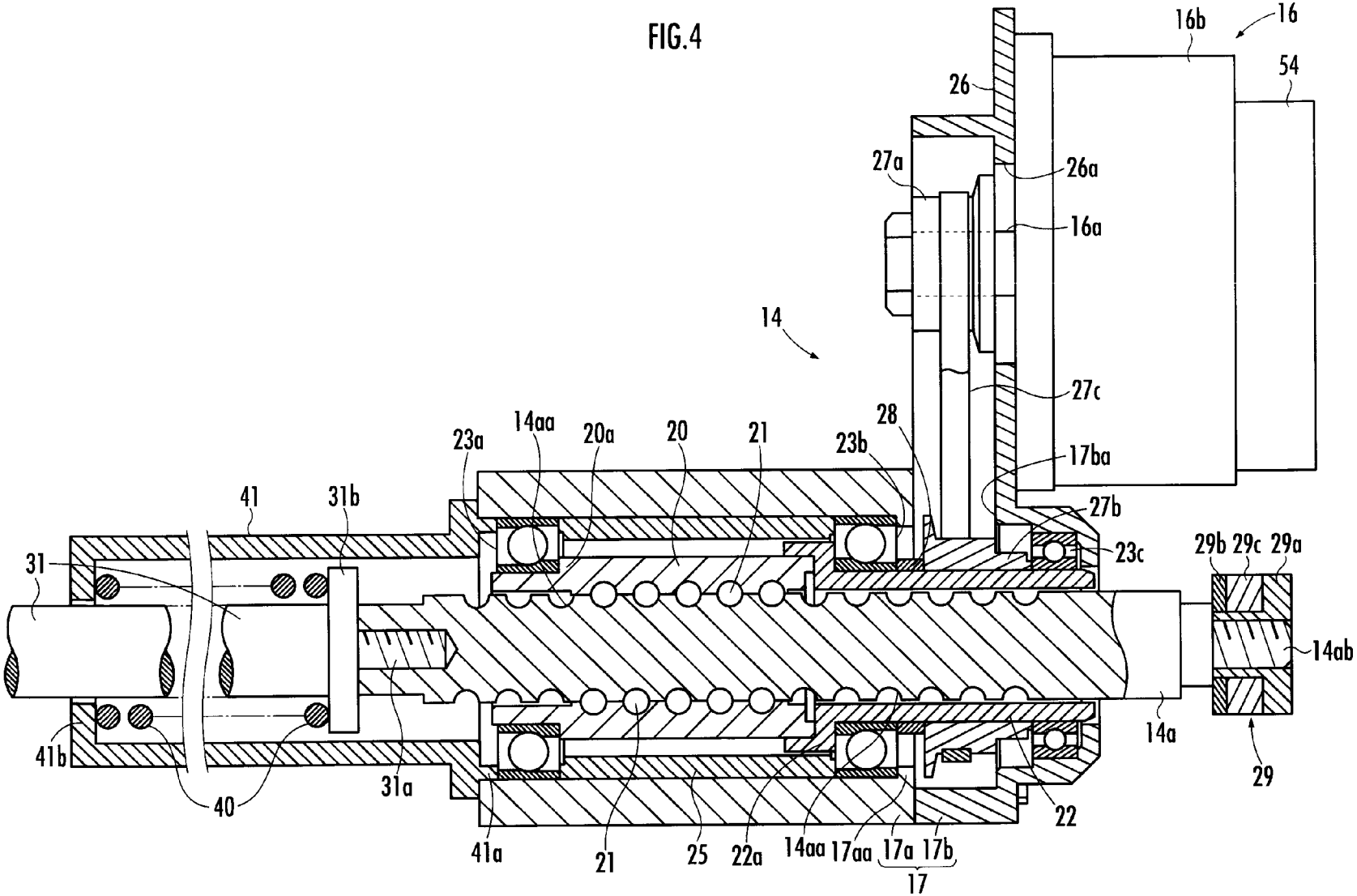
FIG. 4 is a sectional view taken at line IV-IV in FIG. 3.

The following will describe the details of the drive mechanism 9 with reference to FIG. 2 to FIG. 4.

The upper link member 5 to which the drive mechanism 9 is installed has a hollow structure which is open at the end thereof adjacent to the first joint 4 (hereinafter referred to as "the end at the hip side") and at the end thereof adjacent to the third joint 8 (hereinafter referred to as "the end at the knee side), as illustrated in FIG. 2. The linear-motion actuator 14 of the drive mechanism 9 is disposed at a location on the upper link member 5 adjacent to the end at the hip side. The motive power transmit mechanism 15 is accommodated in the upper link member 5, extending from a location adjacent to the end at the hip side of the upper link member 5 to the location adjacent to the end at the knee side.

The linear-motion actuator 14 has an electric motor 16 serving as a rotary actuator and an enclosure 17 accommodating mainly a ball screw mechanism for converting a rotational driving force (torque) output from the electric motor 16 into a translational force in the direction of the axial center of the linear-motion output shaft 14*a*. In this case, the enclosure 17 is composed of a main enclosure 17*a*, which has an approximately square-tubular shape, and a hollow subsidiary enclosure 17*b* secured to one end of the main enclosure 17*a*. A linear-motion output shaft 14*a* penetrates the main enclosure 17*a* and the subsidiary enclosure 17*b*. The enclosure 17 is disposed adjacently to the end at the hip side of the upper link member 5 such that the main enclosure 17*a* and the subsidiary enclosure 17*b* are positioned on the inner side and the cuter side, respectively, of the upper link member 5, and the axial center of the linear-motion output shaft 14*a* is approximately oriented in the lengthwise direction of the upper link member 5. Further, in the present embodiment, one end of a spring case 41, which has an approximately cylindrical shape and which accommodates a coil spring 40 serving as an elastic member, is secured to the other end of the main enclosure 17*a* (the end on the opposite side from the subsidiary enclosure 17*b*). The end of the linear-motion output shaft 14*a* adjacent to the main enclosure 17*a* projects into the spring case 41.

As illustrated in FIG. 3, a pair of bearing members 18 and 18 respectively incorporating bearings 18*a* is installed on both sides of the main enclosure 17*a* in the direction orthogonal to the axial center of the linear-motion output shaft 14*a* (the direction substantially perpendicular to the paper surface of FIG. 2). These bearing members 18 and 18 are secured to the main enclosure 17*a* such that the respective bearings 18*a* thereof coaxially oppose.

A support shaft 19, which is protrusively provided such that the support shaft 19 has an axial center parallel to the joint axis of the third joint 8, is fitted from the inner wall of the upper link member 5 into the inner ring of the bearing 18*a* of each of the bearing members 18. With this arrangement, the enclosure 17 is supported by the upper link member 5 such that the enclosure 17 swings about the axial center of the support shaft 19. Hereinafter, the support shaft 19 will be referred to also as the swing shaft 19.

The main enclosure 17*a* accommodates an essential section of the ball screw mechanism. In the present embodiment, the linear-motion output shaft 14*a* serves as the threaded shaft of the ball screw mechanism, a spiral thread groove 14*aa* being formed in the outer peripheral surface thereof. Further, the ball screw mechanism has a cylindrical nut member 20 externally inserted coaxially to the linear-motion output shaft 14*a* and a plurality of balls 21 which is retained by the inner peripheral portion of the nut member 20 and which engages with the thread groove 14*aa*. The nut member 20 and the balls 21 are accommodated in the main enclosure 17*a*. Rotating the nut member 20 about the axial center of the linear-motion output shaft 14*a* causes the balls 21 to roll along the thread groove 14*aa* while the linear-motion output shaft 14*a* moves in the direction of the axial center relative to the nut member 20.

The nut member 20 is disposed in the main enclosure 17*a* such that the central portion thereof in the direction of the axial center is positioned between the swing shafts 19 and 19. More specifically, the nut member 20 is provided such that the axial center of the nut member 20 and the axial centers of the swing shafts 19 and 19 are orthogonal to each other substantially at the center therein.

The cylindrical member 22 is secured to one end of the nut member 20 in the direction of the axial center (the end adjacent to the subsidiary enclosure 17*b*) and externally inserted onto the linear-motion output shaft 14*a* coaxially with the nut member 20. The cylindrical member 22 has a clearance between itself and the linear-motion output shaft 14*a* and extends from the interior of the main enclosure 17*a* to the interior of the subsidiary enclosure 17*b*. Further, bearings 23*a* and 23*b*, which are coaxial with the nut member 20, are interposed between the outer peripheral surface of the other end of the nut member 20 (the end on the opposite side from the subsidiary enclosure 17*b* and the inner peripheral surface of the main enclosure 17*a* and between the outer peripheral surface of the cylindrical member 22, the outer peripheral surface being adjacent to the nut member 20, and the inner peripheral surface of the main enclosure 17*a*, respectively. Further, a bearing 23*c*, which is coaxial with the nut member 20, is interposed between the outer peripheral surface of the end of the cylindrical member 22 opposite from the nut member 20 and the inner peripheral surface of the subsidiary enclosure 17*b*. With this arrangement, the nut member 20 and the cylindrical member 22 are supported by the enclosure 17 through the intermediary of the bearings 23*a*, 23*b*, and 23*c* such that the nut member 20 and the cylindrical member 22 may integrally rotate about the axial centers thereof, i.e., about the axial center of the linear-motion output shaft 14*a*.

In the present embodiment, the nut member 20 and the cylindrical member 22 are separate structures. Alternatively, however, the nut member 20 and the cylindrical member 22 may be combined into one piece.

Here, when the nut member 20 rotates, the linear-motion output shaft 14*a* moves in the direction of the axial center thereof, causing a force in the direction of the axial center (thrust force) to act on the nut member 20. In the present embodiment, therefore, among the bearings 23*a*, 23*b*, and 23*c*, the bearings 23*a* and 23*b* positioned adjacently to the ends of the nut member 20 in the direction of the axial center are constituted of angular bearings.

In this case, a jaw 20*a* formed on the outer peripheral surface of the nut member 20 is abutted against an end surface of both end surfaces in the direction of the axial center of the inner ring of the bearing 23*a*, the end surface being adjacent to the bearing 23*b*. Further, an annular protrusion 41*a* projecting from an end surface of the spring case 41 (the end surface being adjacent to the main enclosure 17*a*) is abutted against an end surface of both end surfaces in the direction of the axial center of the outer ring of the bearing 23*a*, the end surface being on the opposite side from the bearing 23*b*.

Further, a jaw 22*a* formed on the outer peripheral surface of the cylindrical member 22 is abutted against an end surface of both end surfaces in the direction of the axial center of the inner ring of the bearing 23*b*, the end surface being adjacent to the bearing 23*a*. Further, a jaw 17*aa* formed on the inner peripheral surface of an end portion of the main enclosure 17*a* (the end portion being adjacent to the subsidiary enclosure 17*b*) is abutted against an end surface of both end surfaces in the direction of the axial center of the outer ring of the bearing 23*b*, the end surface being on the opposite side from the bearing 23*a*.

With this arrangement, a thrust force which acts on the nut member 20 when the nut member 20 rotates is received by the main enclosure 17*a* through the intermediary of the bearings (angular bearings) 23*a* and 23*b*. In this case, the nut member 20 and the cylindrical member 22 together function as an inner collar interposed between the bearings 23*a* and 23*b*.

A cylindrical outer collar 25 externally inserted onto the nut member 20 is interposed between the outer ring of the bearing 23*a* and the outer ring of the bearing 23*b*. The outer ring of the bearing 23*a* is placed between the outer collar 25 and the annular protrusion 41*a*. Further, the outer ring of the bearing 23*b* is placed between the outer collar 25 and the jaw 17*aa* of the main enclosure 17*a*.

The bearing members 18 and 18 for swingably supporting the enclosure 17 by the swing shafts 19 and 19 could alternatively be disposed outside the enclosure 17. This, however, would add to the width of the enclosure 17 in the direction of the axial centers of the swing shafts 19 and 19, i.e., the width in the lateral direction thereof, and also add to the widths of the upper link member 5 and the linear-motion actuator 14 in the lateral direction.

According to the present embodiment, therefore, the main enclosure 17*a* and the outer collar 25 therein are provided with openings 17*ab* and 25*b* at the locations where the bearing members 18 are installed (the locations between the bearings 23*a* and 23*b*), as illustrated in FIG. 3. Thus, the bearing members 18 are attached to the main enclosure 17*a* such that the bearing members 18 are positioned within the openings 17*ab* and 25*b* and close to the outer peripheral surface of the nut member 20.

Pore specifically, an opening 25*b* is formed in the cylindrical outer collar 25 by cutting off a part of the side wall thereof. Further, a side wall of the main enclosure 17*a* having the square-tubular shape also has an opening 17*ab* having approximately the same shape as the contour of the bearing member 18. The bearing member 18 is disposed within the openings 17*ab* and 25*b* and bolted to the main enclosure 17*a*.

Thus, the width of the main enclosure 17*a* (the width of the swing shaft 19 in the direction of the axial center thereof) is minimized as much as possible at the mounting location of each of the bearing members 18 by restraining each of the bearing members 18 from projecting from the outer surface of the main enclosure 17*a*.

As illustrated in FIG. 4, a bracket 26 made integral with the subsidiary enclosure 17*b* is protrusively provided sideways (in the direction substantially orthogonal to the axial center of the linear-motion output shaft 14*a* and the axial center of the swing shaft 19) from the outer surface of the subsidiary enclosure 17*b*. In the present embodiment, the bracket 26 protrudes from the subsidiary enclosure 17*b* toward the guide rail 11 (see FIG. 2). A housing 16*b* of the electric motor 16 is secured to the bracket 26.

In this case, an output shaft (rotating output shaft) 16*a* of the electric motor 16 is oriented in the direction parallel to the axial center of the linear-motion output shaft 14*a*, penetrating a hole 26*a* provided in the bracket 26. The output shaft 16*a* of the electric motor 16 has a drive pulley 27*a* secured thereto, the drive pulley 27*a* being integrally rotatable with the output shaft 16*a*. A side wall of the subsidiary enclosure 17*b* has a hole 17*ba* at a location opposing the drive pulley 27*a* in the direction orthogonal to the axial center of the linear-motion output shaft 14*a*. The drive pulley 27*a* opposes the cylindrical member 22 inside the subsidiary enclosure 17*b* through the hole 17*ba*.

The subsidiary enclosure 17*b* accommodates a driven pulley 27*b*, which is coaxial with the cylindrical member 22 and located between the bearings 23*b* and 23*c*. The driven 27*b* is inserted in the outer peripheral surface of the cylindrical member 22 such that the driven pulley 27*b* can be rotated integrally with the cylindrical member 22 and the nut members 20, and opposes a drive pulley 27*a* through the hole 17*ba*. An end surface of the driven pulley 27*b*, which end surface is adjacent to the bearing 23*c*, is abutted against an end surface of the inner ring of the bearing 23*c*. A cylindrical collar 28 externally inserted onto the cylindrical member 22 is interposed between an end surface of the driven pulley 27*b*, which end surface is adjacent to the bearing 23*b*, and the inner ring of the bearing 23*b*.

Further, a belt 27*c* is wound around the drive pulley 27*a* and the driven pulley 27*b*, and these two pulleys 27*a* and 27*b* rotate in an interlocking manner by the belt 27*c*. With this arrangement, a rotational driving force output through the output shaft 16*a* by the electric motor 16 (an output torque of the electric motor 16) is transferred to the cylindrical member 22 through the intermediary of a rotation transmitting mechanism (a pulley-belt rotation transmitting mechanism) constituted of the drive pulley 27*a*, the belt 27*c*, and the driven pulley 27*b*.

In this case, the nut member 20 is rotationally driven integrally with the cylindrical member 22, and accordingly, the linear-motion output shaft 14*a* is driven to move in the direction of the axial center thereof. In other words, the rotational driving force of the electric motor 16 is converted into a translational force in the direction of the axial center of the linear-motion output shaft 14*a* through the pulley-belt rotation transmitting mechanism and the ball screw mechanism described above.

In the present embodiment, the electric motor 16 incorporates a speed reducer, which is not shown. The rotational driving force generated in a rotor of the electric motor 16 is output from the output shaft 16*a* through the speed reducer.

As illustrated in FIG. 3 and FIG. 4, a stopper member 29 which restricts the movement amount of the linear-motion output shaft 14*a* is attached to an end of the linear-motion output shaft 14*a*, which end projects from the interior of the enclosure 17 toward the subsidiary enclosure 17*b* (hereinafter referred to as the rear end of the linear-motion output shaft 14*a*). The stopper member 29 is constructed of a nut 29*a* screwed to an external thread 14*ab* protruding from an end surface of the rear end of the linear-motion output shaft 14*a*, a washer 29*b* and an annular cushioning member 29*c* which are externally inserted onto the external thread 14*ab* and sandwiched between the end surface of the rear end of the linear-motion output shaft 14*a* and the nut 29*a*. The annular cushioning member 29*c* is formed of an elastic material, such as urethane rubber, and interposed between the washer 29*b* and the nut 29*a*.

In this case, the outside diameter of the stopper member 29 is slightly larger than the outside diameter of the linear-motion output shaft 14*a* (more specifically, the maximum outside diameter of the portion which projects from) the subsidiary enclosure 17*b*). Thus, the washer 29*b* of the stopper member 29 eventually abuts against the end surface of the cylindrical member 22 (the end surface on the opposite side from the nut member 20) when the linear-motion output shaft 14*a* moves in the direction for the stopper member 29 to approach the subsidiary enclosure 17*b* (toward the left in FIG. 3 and FIG. 4). This abutting restricts further movement of the linear-motion output shaft 14*a*. Further, the annular cushioning member 29*c* elastically deforms to reduce an impact at the time of the abutting. In addition, the washer 29*b* is disposed on the abutting side of the annular cushioning member 29*c* to prevent the annular cushioning member 29*c* from being stuck in the cylindrical member 22 or the like with a resultant malfunction. In the following description, the movement of the linear-motion output shaft 14*a* which causes the stopper member 29 to move toward the subsidiary enclosure 17*b* will be referred to as the forward movement of the linear-motion output shaft 14*a*, while the movement of the linear-motion output shaft 14*a* in the opposite direction therefrom will be referred to as the backward movement of the linear-motion output shaft 14*a*.

Here, when the stopper member 29 abuts against the end surface of the cylindrical member 22 in a state wherein the rotational driving force (the rotational driving force in the direction for the linear-motion output shaft 14*a* to move forward) from the electric motor 16 is acting on the cylindrical member 22, the rotational driving force is applied from the cylindrical member 22 to the stopper member 29. In this case, if the rotational driving force were the one in the direction for loosening the nut 29*a* of the stopper member 29 relative to the external thread 14*ab*, then the nut 29*a* might loosen. For this reason, in the present embodiment, the rotational direction for tightening the nut 29*a* and the direction of rotation of the nut member 20 when the linear-motion output shaft 14*a* moves forward are set such that the direction of the rotational driving force applied from the cylindrical member 22 to the stopper member 29 when the forward movement of the linear-motion output shaft 14*a* causes the stopper member 29 to abut against the end surface of the cylindrical member 22 will be the direction for tightening the nut 29*a* of the stopper member 29. For example, the direction of the threading of the external thread 14*ab* and the nut 29*a* is set such that the nut 29*a* is tightened relative to the external thread 14*ab* by turning the nut 29*a* clockwise. In this case, the direction of threading of the linear-motion output shaft 14*a* and the nut member 20 is set such that the linear-motion output shaft 14*a* moves forward (the nut member 20 moves backward relative to the linear-motion output shaft 14*a*) by turning the nut member 20 of the ball screw mechanism clockwise. This arrangement restrains the rotational driving force in the direction for loosening the nut 29*a* from acting on the stopper member 29 when the stopper member 29 abuts against the end surface of the cylindrical member 22 due to the forward movement of the linear-motion output shaft 14*a*.

The washer 29*b* and the annular cushioning member 29*c* may alternatively be secured to an end surface of the cylindrical member 22 (the end surface being on the opposite side from the nut member 20) instead of providing them at the rear end portion of the linear-motion output shaft 14*a*.

The above has described the detailed construction of the linear-motion actuator 14.

Referring to FIG. 2, the motive power transmit mechanism 15 has a crank arm 30, which is provided on the lower link member 7 coaxially with the joint axis of the third joint 8 (the axial center of the support shaft 8*a*), and a connecting rod 31 extending coaxially with the linear-motion output shaft 14*a* between the crank arm 30 and the linear-motion output shaft 14*a*. Of both ends of the connecting rod 31 in the lengthwise direction, one end adjacent to the linear-motion output shaft 14*a* is secured to the linear-motion output shaft 14*a* by screwing an external thread 31*a* protruding from an end surface of the connecting rod 31 (shown in FIG. 3 and FIG. 4) into the linear-motion output shaft 14*a* (refer to FIG. 3 and FIG. 4). The other end of the connecting rod 31 is connected to the crank arm 30.

The connecting rod 31 may be constructed integrally with the linear-motion output shaft 14*a*.

The crank arm 30 is provided with a pivot pin 33 having an axial center parallel to the joint axis of the third joint 8 (an axial center having an interval from the joint axis). The pivot pin 33 is secured to the lower link member 7. Further, an end portion of the connecting rod 31, the and portion being adjacent to the crank arm 30, is pivotally attached to the pivot pin 33 such that the connecting rod 31 rotates about the axial center of the pivot pin 33. In this case, the connecting rod 31 is pivotally attached to the pivot pin 33 by using, for example, a spherical joint, although not illustrated in detail.

In the motive power transmit mechanism 15 constructed as described above, when the electric motor 16 is operated to cause the linear-motion output shaft 14*a* of the linear-motion actuator 14 to generate a translational force in the direction of the axial center thereof, the generated translational force is applied to the pivot pin 33 of the crank arm 30 through the connecting rod 31. For example, a translational force F acts on the pivot pin 33, as indicated by an arrow F in FIG. 2. At this time, the pivot pin 33 is decentered relative to the joint axis of the third joint 8. Therefore, the translational force F acting of the pivot pin 33 (more specifically, a component of the translational force F, which component is in the direction orthogonal to the straight line connecting the joint axis of the third joint 8 (the axial center of the support shaft 8*a*) and the pivot pin 33) causes a moment (torque) about the joint axis of the third joint 8 to act on the lower link member 7. This torque rotationally drives the lower link member 7 relative to the upper link member 5, bending or stretching the leg link 3 at the third joint 8. In this case, according to the present embodiment, the pivot pin 33 is disposed above the straight line connecting the joint axis of the third joint 8 (the axial center of the support shaft 8*a*) and the swing shaft 19, as observed in the direction of the axial center of the joint axis of the third joint 8. Hence, the third joint 8 is driven in the direction in which the leg link 3 stretches by causing the linear-motion output shaft 14*a* of the linear-motion actuator 14 to generate a translational force in the backward movement direction (a translation force which provides a tensile force between the pivot pin 33 of the crank arm 30 and the nut member 20). In this case, the axial centers of the swing shafts 19 and 19 for swinging the enclosure 17 as the leg link 3 bends or stretches are orthogonal to the axial center of the nut member 20 in the nut member 20 of the ball screw mechanism. This makes it possible to restrain, to a maximum, a bending force from acting on the linear-motion output shaft 14*a* inside the nut member 20. This allows the linear-motion output shaft 14*a* to stably and smoothly move in the direction of the axial center as the nut member 20 is rotationally driven.

In the walking assistance device A according to the present embodiment, the upper link member 5 has the coil spring 40 serving as an elastic member which imparts an urging torque to the third joint 8 in addition to the driving torque imparted to the third joint 8 by the electric motor 16, which serves as the motive power generating source, of the linear-motion actuator 14.

Reference numerals 40*a* and 40*b* in FIG. 2 are related to a second embodiment or a third embodiment, which will be discussed later, and are unnecessary in the description of the present embodiment.

The coil spring 40 is externally inserted to the connecting rod 31 coaxially therewith and accommodated in the spring case 41. Thus, the coil spring 40 is disposed coaxially with the linear-motion output shaft 14*a* between the linear-motion actuator 14 and the third joint 8. In the spring case 41, the coil spring 40 is interposed in a compressed state between an annular jaw 31*b* protrusively provided, extending outward in the radial direction from the outer peripheral surface of the connecting rod 31 (or the linear-motion output shaft 14*a*) and an annular jaw 41*b* protrusively provided, extending inward in the radial direction from the inner peripheral surface of the end portion of the spring case 41 at the opposite side from the enclosure 17. The two ends of the coil spring 40 are respectively in pressure contact with the annular jaws 31*b* and 41*b*. This causes the coil spring 40 to generate an elastic force in the direction of the axial center between the annular jaws 31*b* and 41*b*. Then, the elastic force (hereinafter referred to as "the spring force") urges the connecting rod 31 and the linear-motion output shaft 14*a* in the retreating direction relative to the spring case 41 and the enclosure 17 (and the upper link member 5).

Thus, the spring force generated by the coil spring 40 is converted into a torque about the joint axis DE the third joint 8 (a torque in the direction in which the leg link 3 stretches) through the intermediary of the crank arm 30. Then, the torque is imparted to the third joint 8. Hence, the coil spring 40 imparts the urging torque (hereinafter referred to as "the spring torque") as the urging force in the direction in which the leg link 3 stretches to the joint axis of the third joint 8.

In this case, as the flexion degree of the leg link 3 at the third joint 8 increases, i.e., as the leg link 3 bends, the interval between the annular jaws 31*b* and 41*b* decreases while the amount of compression of the coil spring 40 increases, so that the spring force of the coil spring 40 increases. As a result, the spring force leads to an increase in the translational force in the direction of the axial center of the linear-motion output shaft 14*a* (the translational force in the retreating direction of the linear-motion output shaft 14*a*), which is imparted to the pivot pin 33 of the crank arm 30 through the connecting rod 31.

The relationship between the translational force imparted to the pivot pin 33 in the direction of the axial center of the linear-motion output shaft 14*a* and the torque about the joint axis of the third joint 8 generated by the translational force nonlinearly changes according to the flexion degree of the leg link 3, as will be discussed later. Hence, the spring torque does not necessarily monotonously increase as the flexion degree of the leg link 3 at the third joint 8 increases, i.e., as the spring force increases.

Supplementally, the coil spring 40 and the spring case 41 may alternatively be disposed at the rear of the enclosure 17 (adjacently to the subsidiary enclosure 17*b*). In this case, however, the coil spring 40 and the spring case 41 would project to the rear of the enclosure 17. This would require an extra space for the projecting portion and would tend to interfere with another object. In contrast thereto, according to the present embodiment, the coil spring 40 and the spring case 41 are disposed coaxially with the linear-motion output shaft 14*a* between the linear-motion actuator 14 and the third joint 8 and are accommodated in the upper link member 5. This arrangement allows the assembly combining the coil spring 40 and the drive mechanism 9 to be smaller and makes it possible to avoid the interference with an external object.

The above has described the essential mechanical construction of the walking assistance device A according to the present embodiment. In the walking assistance device A constructed as described above, the seating portion 1 is urged upward by imparting the torque in the direction in which the leg link 3 stretches to the third joint 8 of the leg link 3 connected to the foot-worn portion 2 in contact with the ground. This causes the load providing an upward translational force (hereinafter referred to as "the lifting force") to act on the user from the seating portion 1. In the present embodiment, the torque in the stretching direction of the leg link 3 which is imparted to the third joint 8 is the resultant torque of the driving torque imparted to the third joint 8 from the electric motor 16 and the spring torque imparted to the third joint 8 from the coil spring 40. In the present embodiment, therefore, the lifting force is the resultant force of the component generated from the driving torque imparted to the third joint 8 from the electric motor 16 (hereinafter referred to as "the motor lifting force") and the component generated from the spring torque imparted to the third joint 8 from the coil spring 40 (hereinafter referred to as "the spring lifting force").

The walking assistance device A according to the present embodiment supports a part of the weight of the user (a part of the gravity acting on the user) by the lifting forces, thereby reducing the burden on a leg or legs of the user while the user is walking or when a leg or legs are bent or stretched.

In this case, in the support force for supporting the entire walking assistance device A and user on a floor, i.e., the total translational force applied from a floor to the ground contact surface or surfaces of the walking assistance device A (hereinafter referred to as "the total support force"), the support force for supporting the walking assistance device A itself and a part of the weight of the user on the floor is borne by the walking assistance device A. The rest of the support force is borne by the user. Hereinafter, in the aforesaid total support force, the support force borne by the walking assistance device A will be referred to as the borne-by-assistance-device support force, while the support force borne by the user will be referred to as the borne-by-user support force.

In a static state wherein the inertial force generated by a movement of the user or the walking assistance device A is extremely small, the force obtained by subtracting a support force against the gravity acting on the walking assistance device A, that is, a support force that balances out the gravity, from the borne-by-assistance-device support force will be the aforesaid lifting force. Further, the force obtained by subtracting the lifting force from the support force against the gravity acting on the user (the support force which balances out the gravity) is the borne-by-user support force. The borne-by-assistance-device support force is shared by the two leg links 3 and 3 in a state wherein both legs of the user are standing legs. Further, in a state wherein only one leg is a standing leg, the borne-by-assistance-device support force acts on only the leg link 3 of one leg out of both leg links 3 and 3. The same applies to the borne-by-user support force.

Here, the relationship between the spring torque imparted from the coil spring 40 to the third joint of the leg link 3 and the flexion degree of the leg link 3 at the third joint 8 will be described with reference to FIG. 5 to FIG. 8.

Figure 5:
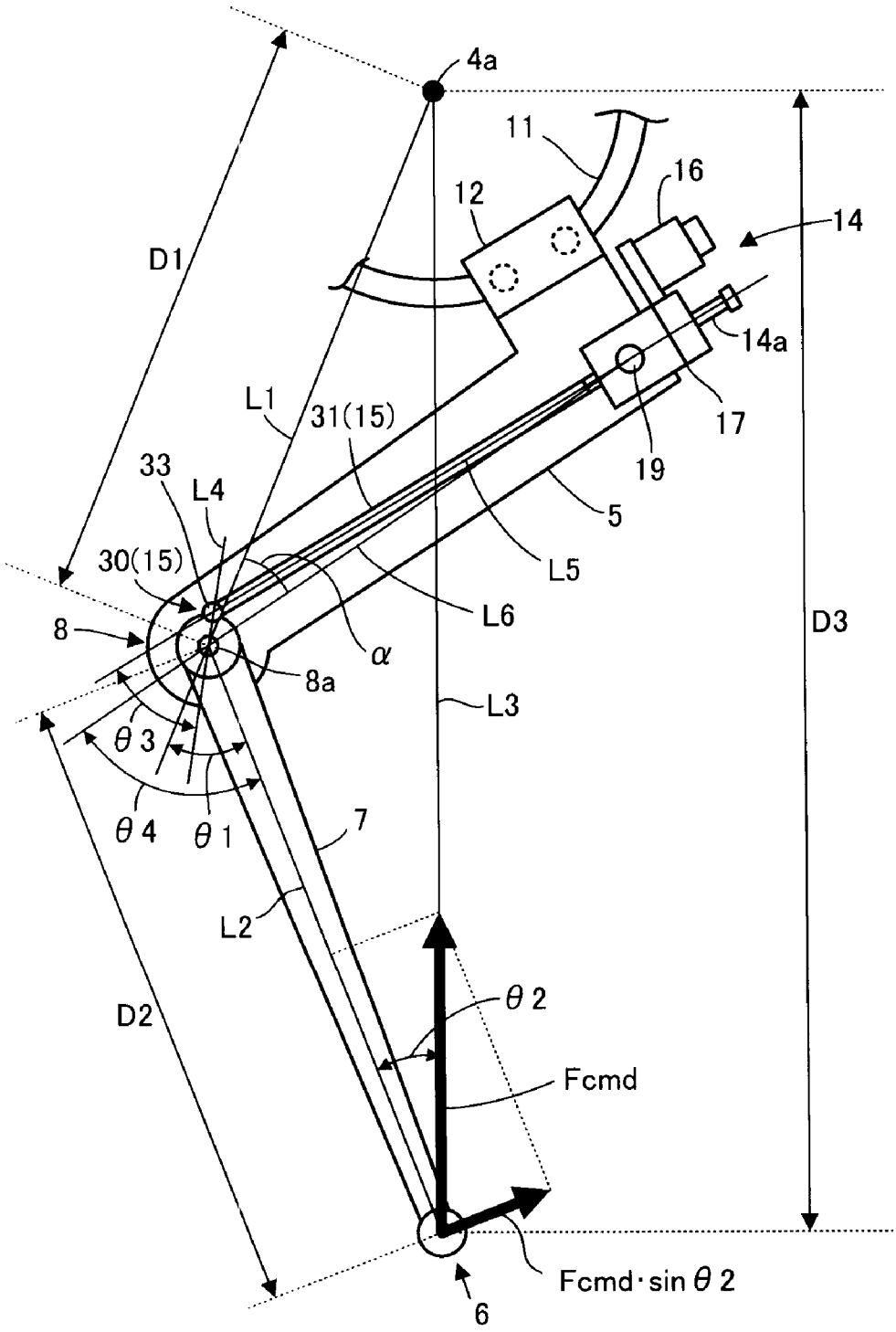
FIG. 5 is a diagram schematically illustrating an essential construction related to one leg link of the walking assistance device according to the embodiment.

Referring to FIG. 5, in the following description, an angle θ1 formed by a straight line L1 connecting the support shaft 8*a* of the third joint 8 and the curvature center 4*a* of the guide rail 11 and a straight line L2 connecting the support shaft 8*a* of the third joint 8 and the second joint 6 provides the index representing the flexion degree of the leg link 3 at the third joint 8 in the case where each of the leg links 3 is observed from the direction of the joint axis of the third joint 8 (in the direction of the axial center of the support shaft 8*a*), i.e., in the case where each of the leg links 3 is observed by projecting the leg link 3 on a plane orthogonal to the joint axis of the third joint 8. Hereinafter, the angle θ1 will be referred to as the knee angle θ1. The knee angle θ1 shown in the figure monotonously increases from an angle in the vicinity of 0 degree to an angle in the vicinity of 180 degrees as the flexion degree of the leg link 3 at the third joint 8 increases, i.e., as the leg link 3 bends at the third joint 8.

Supplementally, according to the present embodiment, the interval between the third joint 8 and the curvature center 4*a* of the guide rail 11 and the interval between the third joint 8 and the second joint 6 are set such that the knee angle θ1 takes an angle that is larger than zero degrees (e.g., approximately 30 degrees) in the state wherein the user of the walking assistance device A is in the upright posture, i.e., in the state wherein the user is standing with his/her both legs stretched straight. In this case, according to the present embodiment, the flexion degree of each of the leg links 3 can be changed within a predetermined variable range by the mechanical restriction by the stopper member 29 and a stopper member (not shown) installed to the third joint 8. The variable range of the flexion degree is a range of, for example, about 30 degrees to about 120 degrees in terms of the range of the corresponding knee angle θ1. The variable range of the knee angle θ1 includes the value of the knee angle θ1 in the state wherein the user is in the upright posture and the range of the knee angle θ1 (e.g., the range of about 30 degrees to about 60 degrees) implemented when the user is in a normal walking mode on a level ground.

Further, when each of the leg links 3 is observed in the direction of the axial center of the joint axis of the third joint 8, an angle θ3 formed by a straight line L3 connecting the support shaft 8*a* of the third joint 8 and the pivot pin 33 serving as the pivotal attaching portion of the linear-motion output shaft 14*a* relative to the crank arm 30 and a straight line L4 which passes the pivot pin 33 and which is parallel to the axial center of the linear-motion output shaft 14*a* (coinciding with the axial center of the linear-motion output shaft 14*a* in the present embodiment) is referred to as a pivot pin phase angle θ3. The pivot pin phase angle θ3 in the figure is set such that the value of θ3 in a state wherein the straight lines L3 and L4 are aligned (a state wherein the joint axis of the third joint 8 is positioned on the axial center of the linear-motion output shaft 14*a*) is zero. Then, the pivot pin phase angle θ3 monotonously increases toward 180 degrees as the pivot pin 33 rotates counterclockwise about the joint axis of the third joint 8 (as the knee angle θ1 increases) from the aforesaid state.

In the leg link 3 connected to the foot-worn portion 2 in contact with the ground, a torque in the direction in which the leg link 3 bends acts on the third joint 3 of the leg link 3 due to the gravity acting on the walking assistance device A (hereinafter referred to as "the attributable-to-gravity torque"). Hence, in order to apply the lifting force to the user from the seating portion 1 or to prevent the seating portion 1 from freely falling due to gravity, it is necessary to impart to the third joint 8 of each of the leg links 3 a torque which is in the opposite direction from that of the attributable-to-gravity torque, i.e., a torque in the direction in which the leg link 3 stretches, and which has a magnitude not less than that of the attributable-to-gravity torque.

In this case, in the state wherein the operation of the electric motor 16 of the linear-motion actuator 14 has been stopped after using the walking assistance device A (in the state wherein the power of the electric motor 16 has been turned off), only the spring torque by the coil spring 4C is imparted to the third joint 8 as the torque in the direction in which the leg link 3 stretches. If the magnitude of the spring torque is excessively smaller than that of the attributable-to-gravity torque, then the seating portion 1 inconveniently falls by gravity unless the user or an attendant for the user voluntarily supports the seating portion 1 in the state wherein the operation of the electric motor 16 has been stopped.

According to the present embodiment, therefore, in a state wherein the right and left foot-worn portions 2 and 2 are in contact with the ground (more specifically, in a state wherein the right and left foot-worn portions 2 and 2 are in contact with the ground such that the support force acting from a floor to the right leg link 3 and the support force acting from a floor to the left leg link 3 are substantially equal; the state will be hereinafter referred to as "the state wherein both legs are evenly in contact with the ground"), the spring torque at each of the leg links 3 is set so as to substantially balance out the attributable-to-gravity torque in the case where the flexion degrees of both leg links 3 and 3 of the walking assistance device A lie within a predetermined range which includes the flexion degree in the state wherein the user is in the upright posture in the variable range.

More specifically, according to the present embodiment, the characteristic of spring torque relative to the knee angle θ1 of each of the leg links 3 is set such that the support force acting on each of the two leg links 3 and 3 from a floor (hereinafter referred to as "the borne-by-leg-link support force at motor off") changes as illustrated by, for example, a curve a3 in FIG. 8, according to the knee angles θ1 of both leg links 3 and 3 in the case where the operation of the walking assistance device A is in the state in which both legs are evenly in contact with the ground and the operations of both electric motors 16 and 16 have been stopped (hereinafter referred to as "the state wherein both legs are evenly in contact with the ground at motor off").

Here, the state wherein both legs are evenly in contact with the ground, including the state wherein both legs are evenly in contact with the ground at motor off, is a state wherein the magnitudes of the support forces acting on the right and left leg links 3 and 3, respectively, from the floor are substantially equal. Hence, the magnitudes of the borne-by-leg-link support forces at motor off of the right and left leg links 3 and 3 are substantially equal. Further, the state wherein the spring torque at the leg links 3 and the attributable-to-gravity torque are balanced in the state wherein both legs are evenly in contact with the ground at motor off is a state wherein the magnitude of the borne-by-leg-link support force at motor off of each of the right and left leg links 3 and 3 is equal to substantially half the magnitude of the gravity acting on the walking assistance device A (in other words, the magnitude of the total sum of the borne-by-leg-link support forces at motor off of the right and left leg links 3 and 3 is substantially equal to the magnitude of the gravity acting on the walking assistance device A). The relationship between the borne-by-leg-link support force at motor off and spring torque is determined according to expression (1) given below.

$$\text{Borne-by-leg-link support force at motor off} = \text{Spring torque}/(D2 \cdot \sin \theta 2) \quad (1)$$

Referring to FIG. 5, D2 in the above expression (1) denotes the interval between the third joint 8 and the second joint 6, and θ2 denotes an angle formed by the straight line L3 connecting the curvature center 4*a* of the guide rail 11 and the second joint 6 and the straight line L2 connecting the third joint 8 and the second joint 6. In this case, regarding each of the leg links 3, if the interval between the curvature center 4*a* and the second joint 6 is denoted by D3 and the interval between the curvature center 4*a* and the third joint 8 is denoted by D1, as illustrated in FIG. 5, then relational expressions (2) and (3) given below hold.

$$D3^2 = D1^2 + D2^2 - 2 \cdot D1 \cdot D2 \cdot \cos(180° - \theta 1) \quad (2)$$

$$D1^2 = D2^2 + D3^2 - 2 \cdot D2 \cdot D3 \cdot \cos \theta 2 \quad (3)$$

Hence, D3 can be calculated from the values of D1 and D2, which are constant values, and the knee angle θ1 according to expression (2). Further, the angle θ2 can be calculated from the value of D3 and the values of D1 and D2 according to expression (3). Thus, the angle θ2 provides the function of θ1, allowing θ2 to be calculated from the value of θ1. Further, once the value of the angle θ1 is determined, the ratio between a borne-by-leg-link support force at motor off corresponding to the value of the angle θ1 and a spring torque will be determined according to expression (1) mentioned above.

According to the characteristic indicated by the curve a3 in FIG. 8, in the case where the knee angle θ1 lies within a range of a predetermined angle θ1*a* or less, the borne-by-leg-link support force at motor off is substantially equal to a support force having a magnitude that is half the magnitude of the gravity acting on the) n entire walking assistance device A (the support force having the magnitude indicated by the dashed line in FIG. 8, which will be hereinafter referred to as the self-weight-bearing support force). In other words, the self-weight-bearing support force means the share per leg link 3 out of the support force for supporting the gravity acting on the walking assistance device A in the state wherein both legs are evenly in contact with the ground. The predetermined angle θ1*a* is closer to an angle in the state wherein the user is in the upright posture (≈30 degrees) than a maximum angle (the angle corresponding to a maximum flexion degree of the leg link 3) in the variable range of θ1.

Further, in the case where the knee angle θ1 is larger than the predetermined angle θ1*a*, the borne-by-leg-link support force at motor off gradually increases to be a support force that is larger than the self-weight bearing support force and then decreases as the knee angle θ1 increases. In this case, if the knee angle θ1 is larger than a predetermined angle close to a maximum angle θ1*b* (>θ1*a*), then the borne-by-leg-link support force at motor off decreases to a support force that is smaller than the self-weight bearing support force.

In the present embodiment, the relationship between the spring torque and the knee angle θ1 is set such that the borne-by-leg-link support force at motor off changes in relation to the knee angle θ1 as described above. This characteristic is implemented by appropriately setting the relationship between the pivot pin phase angle θ3 and the knee angle θ1.

Figure 6:
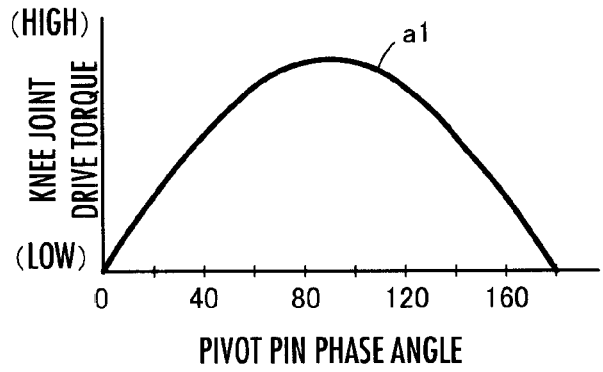
FIG. 6 is a graph illustrating the characteristic of a motive power transmitting mechanism of a drive mechanism of the walking assistance device according to the embodiment.

More specifically, in the motive power transmission mechanism 15 according to the present embodiment, in the case where the translational force acting on the pivot pin 33 of the crank arm 30 is fixed in the direction of the axial center of the linear-motion output shaft 14*a* of the linear-motion actuator 14 is fixed, that is, in the case where the translational force in the direction of the axial center generated at the linear-motion output shaft 14*a* is fixed, the torque imparted to the third joint 8 through the crank arm 30 (hereinafter referred to as the knee joint drive torque) changes relative to the pivot pin phase angle θ3 as indicated by a curve a1 in FIG. 6. More specifically, the knee joint drive torque reaches a maximum thereof in the case where the pivot pin phase angle θ3 is 90 degrees. Further, as the pivot pin phase angle θ3 decreases toward zero degrees or increases toward 180 degrees from 90 degrees, the knee joint drive torque decreases. Thus, the ratio of the knee joint drive torque relative to the translational force acting or the pivot pin 33 of the crank arm 30 exhibits a nonlinear characteristic relative to the pivot pin phase angle θ3.

Figure 7:
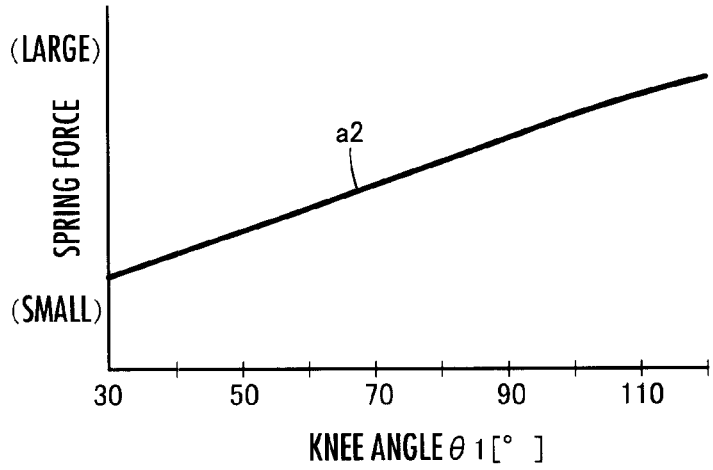
FIG. 7 is a graph illustrating the characteristic of an elastic member (coil spring) of a walking assistance device according to a first embodiment.

Meanwhile, the spring force of the coil spring 40 chances in relation to the knee angle θ1 as indicated by a line a2 in FIG. 7. More specifically, according to the present embodiment, the change rate of the spring force, namely, the spring constant, relative to a change in the compression amount (elastic deformation amount) of the coil spring 40 is set to a fixed value. For this reason, the spring force monotonously increases as the knee angle θ1 increases.

Further, the characteristic of the spring torque and the borne-by-leg-link support force at motor off relative to the knee angle θ1 is defined depending on the relationship between the knee angle θ1 and the pivot pin phase angle θ3. The change amount of the knee angle θ1 and the change amount of the pivot pin phase angle θ3 will be the same. Therefore, once the value of the pivot pin phase angle θ3 corresponding to the value of an arbitrary knee angle θ1 is determined, the relationship between θ1 and θ3 will be determined Referring to FIG. 5, according to the present embodiment, the relationship between an angle θ4 (=θ3+α) and the angle θ1, that is, the relationship between θ3 and θ1, is set such that the pivot pin phase angle θ3 is substantially equal to the angle θ4 formed by the straight line L2 connecting the third joint 8 and the second joint 6 and a straight line L6 connecting the third joint 8 and the swing shaft 19 (equivalent to the angle obtained by adding a certain angle α (the angle formed by the straight lines L1 and L6) to the knee angle θ1) in the case the leg link 3 is observed in the direction of the axial center of the joint axis of the third joint 8.

Figure 8:
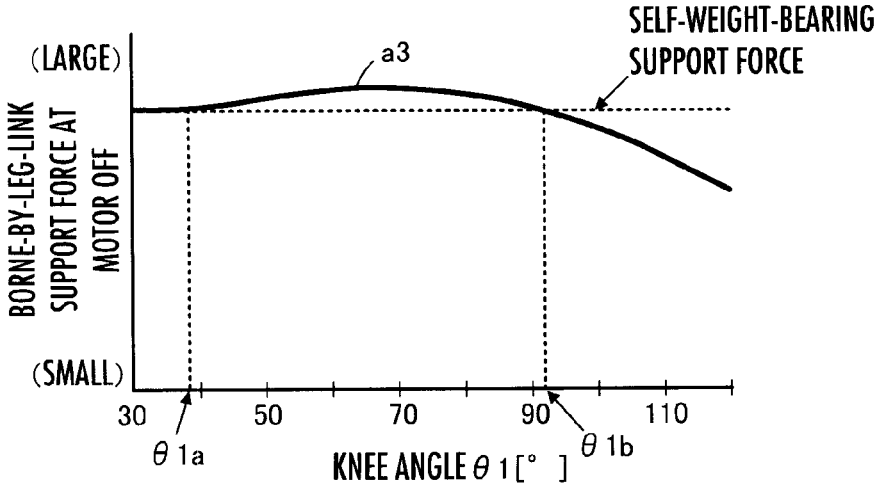
FIG. 8 is a graph illustrating the characteristic of the leg link bearing support force when a motor of the walking assistance device in the first embodiment stops.

In the present embodiment, the characteristic indicated by the curve a3 in FIG. 8 is implemented by setting the relationship between θ3 and θ1 as described above.

The characteristic of the spring torque, that is, the borne-by-leg-link support force at motor off, relative to θ1 is set as described above, so that a spring torque balancing out the torque attributable to gravity is imparted to the third joint 8 of each of the leg links 3 in a state wherein the knee angles θ1 of both leg links 3 and 3 are θ1*a* or more, including the state wherein the user is in the upright posture. Hence, a change in the knee angle θ1 of each of the leg links 3 will be restrained thereby to permit prevention of the seating portion 1 from free fall attributable to gravity by stopping the operation of the electric motors 16 and 16 in the state wherein the knee angles θ1 of both leg links 3 and 3 are θ1*a* or more (the state wherein the user is in the upright posture or a state close thereto) after using the walking assistance device A.

Even if the borne-by-leg-link support force at motor off slightly disagrees with the self-weight-bearing support force, that is, even if there is a slight difference between the magnitude of a spring torque and the magnitude of the attributable-to-gravity torque, a change in the knee angle θ1 of each of the leg links 3 will be restrained by a certain amount of frictional force generated between the upper link member 5 and the lower link member 7. Hence, the free fall of the seating portion 1 caused by gravity can be prevented as long as the magnitude of the resultant torque of a spring torque and the attributable-to-gravity torque remains within the range of torque that can be generated by the frictional force between the upper link member 5 and the lower link member 7.

Further, when the angle θ1 is the angle θ1*b* or more, the magnitude of the spring torque will be smaller than that of the attributable-to-gravity torque. Hence, the resultant torque of the spring torque and the attributable-to-gravity torque will be a torque in the direction in which the leg link 3 bends. With this arrangement, the state wherein the flexion degrees of both leg links 3 and 3 are maximum flexion degrees, that is, the state wherein the walking assistance device A has been most compactly folded can be stably maintained. This allows the walking assistance device A to be easily accommodated in a relatively small storage space.

Supplementally, according to the present embodiment, the flexion degree of the leg link 3 corresponding to an arbitrary knee angle θ1 that is the predetermined angle θ1*a* or less corresponds to the first flexion degree in the present invention. Further, the posture of the leg link 3 at the flexion degree at which θ1≦θ1*a* corresponds to the predetermined posture in the present invention. The state wherein θ1≦θ1*a* holds in the state wherein both legs are evenly in contact with the ground corresponds to the reference state in the present invention. The flexion degree of the leg link 3 in the case where the knee angle θ1 agrees with the predetermined angle θ1*b* corresponds to the second flexion degree in the present invention.

The configuration for controlling the operation of the walking assistance device A of the present embodiment will now be described. In the walking assistance device A of the present embodiment, a controller 51 (control unit) which controls the operation of the electric motor 16 of each of the linear-motion actuators 14 is accommodated in the base frame 1*b* of the seating portion 1, as illustrated in FIG. 1.

The walking assistance device A is further provided with the sensors described below and the outputs of the sensors are input to the controller 51 as detection data for controlling the operation of the electric motors 16. As illustrated in FIG. 1, the shoe 2*a* of each of the foot-worn portions 2 includes a pair of tread force measuring sensors 52*a* and 52*b* for measuring the tread force of each leg (the vertical translational force that presses the foot of each leg against a floor surface) of the user.

In other words, the tread force of each leg is a translational force that balances out the force acting on each leg (shared by each leg) in a support force borne by the user. Hence, the magnitude of the total sum of the tread forces of both legs is equal to the magnitude of the support force borne by the user. In the present embodiment, the tread force measuring sensors 52*a* and 52*b* are attached to the bottom surface of the insole 2*c* in the shoe 2*a* at one front location immediately below the metatarsophalangeal joint (MP joint) and one rear location immediately below the heel of a foot of the user such that the two front and rear sensors oppose each other at the bottom of the foot of the user. Each of the tread force measuring sensors 52*a* and 52*b* is composed of a one-axis force sensor and generates outputs based on translational forces in the direction perpendicular to the bottom surface of the shoe 2*a*.

Further, as illustrated in FIG. 2, a strain gauge force sensor 53 serving as the force sensor for measuring the translational force transmitted to the pivot pin 33 of the crank arm 30 through the connecting rod 31 from the linear-motion output shaft 14*a* (hereinafter referred to as the rod transmission force) is installed at a location on the connecting rod 31 of each of the motive power transmission mechanism 15, the location being adjacent to the third joint 8.

The strain gauge force sensor 53 is a publicly known sensor composed of a plurality of strain gauges (not shown) secured to the outer peripheral surface of the connecting rod 31. The strain gauge force sensor 53 generates an output based on a translational force (the rod transmission force) acting on the connecting rod 31 in the direction of the axial center thereof (in the direction of the axial center of the linear-motion output shaft 14*a*). In this case, the rod transmission force to be measured by the strain gauge force sensor 53 is a translational force, which combines the translational force transmitted to the connecting rod 31 through the ball screw mechanism from the electric motor 16 and the translational force transmitted to the connecting rod 31 from the coil spring 40 (the spring force). Incidentally, the strain gauge force sensor 53 has high sensitivity to the translational forces in the direction of the axial center of the connecting rod 31. Meanwhile, the strain gauge force sensor 53 exhibits sufficiently low sensitivity to forces in the shear direction (the transverse direction) of the connecting rod 31.

Further, each of the electric motor 16 is provided with an angle sensor 54 (shown in FIG. 4) such as a rotary encoder which generates outputs based on the rotational angles from a reference position of the output shaft 16*a* or the rotor of the electric motors 16 in order to measure the knee angle θ1 used as the index of the flexion degree of each of the leg links 3 at the third joint 8. In the present embodiment, the knee angle θ1 of each of the leg links 3 is uniquely determined on the basis of the rotational angle of the output shaft 16*a* or the rotor of each of the electric motors 16. This means that the outputs of the angle sensor 54 will be based on the knee angles θ1.

Supplementally, the third joint 8 of each of the leg links 3 may be provided with an angle sensor, such as a rotary encoder or a potentiometer, to directly measure the knee angle θ1 of each of the leg links 3 by the angle sensor.

The function of the controller 51 will now be described in more detail with reference to FIG. 9 and FIG. 10. In the following description, to distinguish the right and left in the walking assistance device A, suffixes "R" and "L" may be added to the ends of reference numerals. For example, the right leg link 3 observed from the front of the user will be denoted by "the leg link 3R" and the left leg link 3 will be denoted by "the leg link 3L". The suffixes "R" and "L" following reference numerals will be used to mean that they relate to the right leg link 3R and the left leg link 3L.

Figure 9:
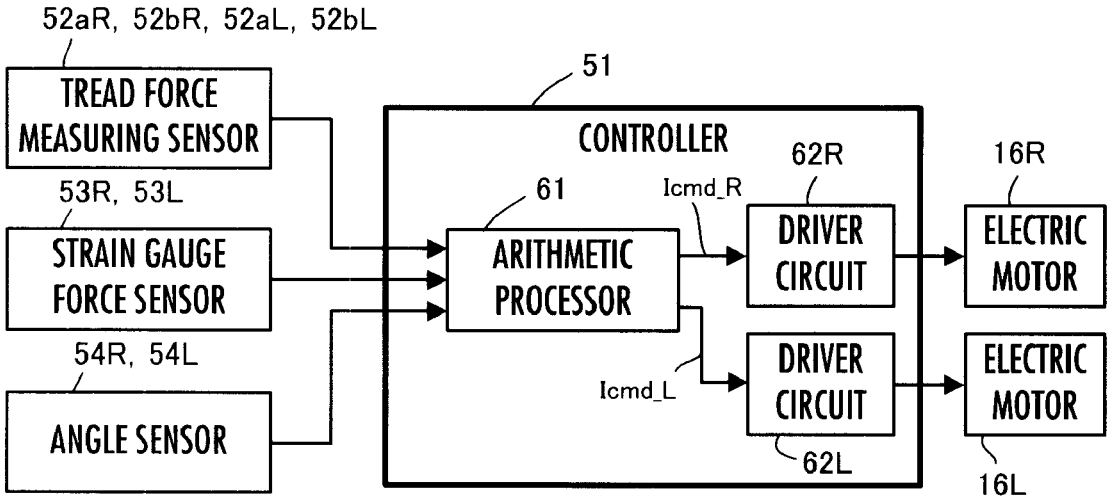
FIG. 9 is a block diagram schematically illustrating the hardware construction of a controller which controls the operation of the walking assistance device according to the embodiment.

As illustrated in FIG. 9, the controller 51 has an arithmetic processor 61 and driver circuits 62R and 62L for energizing the electric motors 16R and 16L of the linear-motion actuators 14R and 14L, respectively. The arithmetic processor 61 is constructed of a microcomputer including a CPU, a RAM and a ROM. The arithmetic processor 61 receives the outputs of the tread force measuring sensors 52*a*R, 52*b*R, 52*a*L and 52*b*L, the outputs of the strain gauge force sensors 53R, 53L, and the outputs of the angle sensors 54R and 540 through the intermediary of an interface circuit (not shown) composed of an A/D converter and the like. Then, the arithmetic processor 61 uses the input detection data, and reference data and programs which have been stored in advance to execute predetermined arithmetic processing thereby to determine command current values Icmd_R and Icmd_L, which are the command values (target values) of the currents for energizing the electric motors 16R and 16L. Further, the arithmetic processor 61 controls the driver circuits 62R and 62L so as to supply the currents of the command current values Icmd_R and Icmd_L to the electric motors 16R and 16L, respectively. Thus, the output torques of the electric motors 16R and 16L are controlled.

Figure 10:
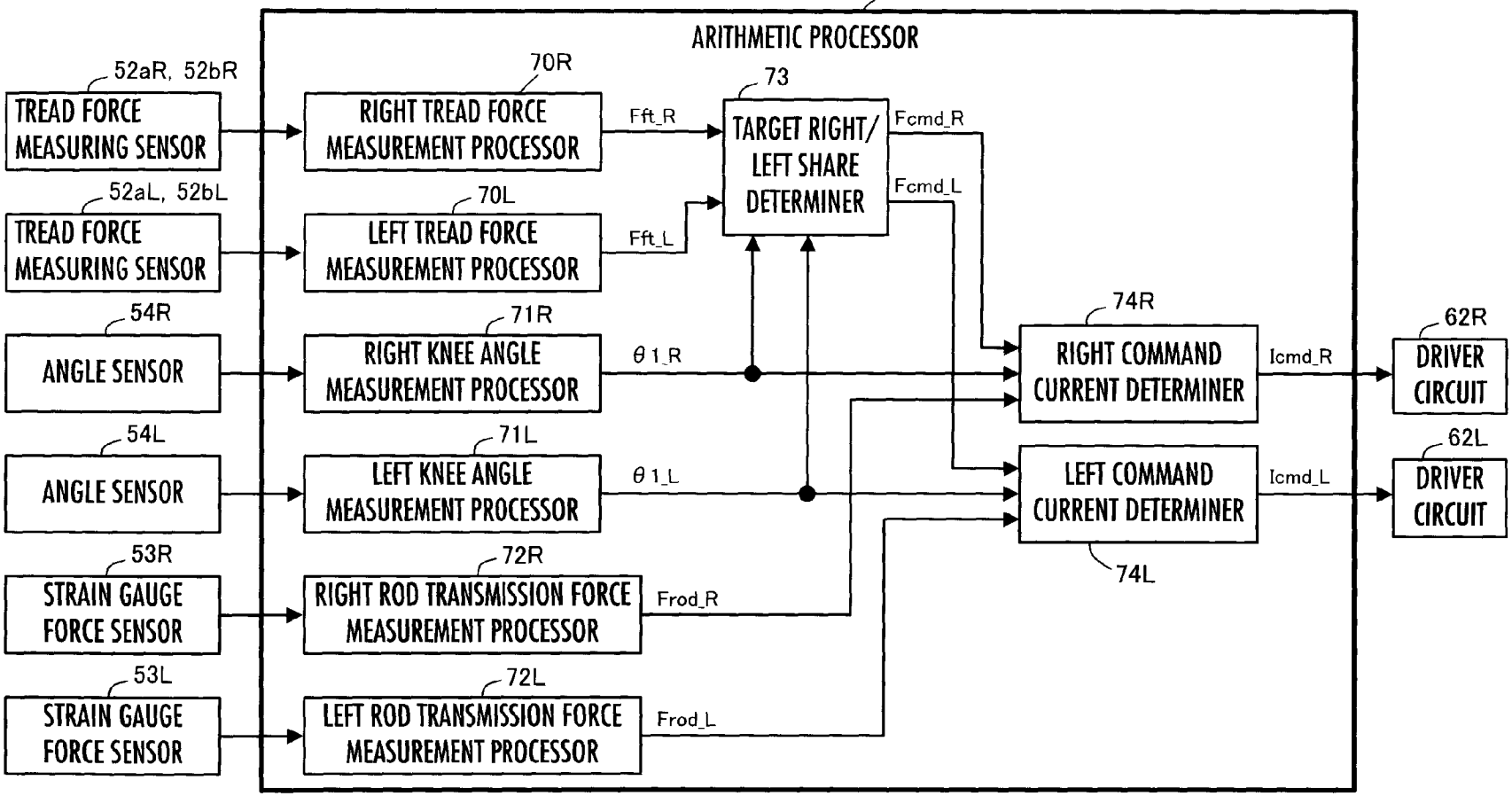
FIG. 10 is a block diagram illustrating a processing function of an arithmetic processor of the controller in FIG. 9.

The arithmetic processor 61 has the functional devices as illustrated in the block diagram of FIG. 10 to determine the command current values Icmd_R and Icmd_L. The functions of the devices are implemented by a program installed in the arithmetic processor 61.

As illustrated in FIG. 10, the arithmetic processor 61 is provided with a right tread force measuring processor 70R for measuring the tread force of the right leg of the user on the basis of the outputs of the right tread force measuring sensors 52*a*R, 52*b*R, a left tread force measuring processor 70L for measuring the tread force of the left leg of the user on the basis of the outputs of the left tread force measuring sensors 52*a*L, 52*b*L, a right knee angle measuring processor 71R for measuring the knee angle of the leg link 3R on the basis of an output of a right angle sensor 54R, a left knee angle measuring processor 71L for measuring the knee angle of the leg link 3L on the basis of an output of a left angle sensor 54L, a right roc transmission force measurement processor 72R for measuring the rod transmission force of a motive power transmission mechanism 15R on the basis of an output of a right strain gauge sensor 53R, and a left rod transmission force measurement processor 72L for measuring the rod transmission force of a motive power transmission mechanism 15L on the basis of an output of a left strain gauge sensor 53L.

Further, the arithmetic processor 61 has a target right/left share determiner 73 which determines target values Fcmd_R and Fcmd_L for the shares of the leg links 3R and 3L of the borne-by-assistance-device support force (more specifically, the target values Fcmd_R and Fcmd_L of the support forces acting from a floor to the leg links 3R and 3L through the intermediary of the second joints 6R and 6L). The target right/left share determiner 73 receives right and left tread force values (measurement values) Fft_R and Fft_L measured by the tread force measurement processors 70R and 70L and right and left knee angle measurement values θ1_R and θ1_L measured by the knee angle measurement processors 71R and 71L to determine the target values Fcmd_R and Fcmd_L.

Supplementally, to be more accurate, the total sum of the support forces acting on the leg links 3R and 3L from a floor through the intermediary of the second joints 6R and 61, respectively (hereinafter referred to as "the total Lifting force") is obtained by subtracting the support force for supporting both foot-worn portions 2R and 2L on the floor from the borne-by-assistance-device support force. In other words, the total lifting force means an upward translational force for supporting the walking assistance device A excluding both foot-worn portions 2R and 2L and for supporting a part of the weight of the user. However, the total weight of both foot-worn portions 2R and 2L is sufficiently small in comparison with the total weight of the walking assistance device A, so that the total lifting force substantially agrees with the borne-by-assistance-device support force. In the following description, the shares of the leg links 3R and 3L of the borne-by-assistance-device support force will be referred to as the total lifting force share. Further, the target values Fcmd_R and Fcmd_L of the total lifting force shares of the leg links 3R and 3L, respectively, will be referred to as the target leg link share values Fcmd_R and Fcmd_L.

The arithmetic processor 61 further includes a right command current determiner 74R which determines the command current value Icmd_R of the electric motor 16R on the basis of a measurement value Frod_R of a rod transmission force of the motive power transmission mechanism 15R measured by the right rod transmission force measurement processor 72R, the right target leg link share value Fcmd_R determined by the right/left target share determiner 73, and the knee angle measurement value θ1_R of the leg link 3R measured by the right knee angle measurement processor 71R, and a left command current determiner 74L which determines the command current value Icmd_L of the electric motor 16L on the basis of a measurement value Frod_L of a rod transmission force of the motive power transmission mechanism 15L measured by the left rod transmission force measurement processor 72L, the left target leg link share value Fcmd_L determined by the right/left target share determiner 73, and the knee angle measurement value θ1_L of the leg link 3L measured by the left knee angle measurement processor 71L.

The processing carried out by the arithmetic processor 51 will be described in detail with reference to FIG. 11 to FIG. 13.

In a state wherein the foot-worn portions 2 have been attached to the feet of the user and the seating portion 1 has been disposed under the crotch of the user, the power of the controller 51 is turned on. At this time, electric power becomes ready to be supplied from a power battery (not shown) to the electric motors 16 through the intermediary of the driver circuits 62. The arithmetic processor 61 carries out the processing, which will be described below, at predetermined control processing cycles.

In each control processing cycle, the arithmetic processor 61 first implements the processing by the tread force measurement processors 70R, 70L, the processing by the knee angle measurement processors 71R, 71L, and the processing by the rod transmission force measurement processors 72R, 72L. The processing by the rod transmission force measurement processors 72R and 72L may be carried out after or in parallel with the processing by the target right/left share determiner 73, which will be discussed later.

The processing by the tread force measurement processors 70R and 70L is carried out as described below. The same processing algorithm applies to both tread force measurement processors 70R and 70L. The processing by the right tread force measurement processor 70R will be representatively described.

The right tread force measurement processor 70R adds up the force detection values indicated by the outputs of the tread force measurement sensors 52*a*R and 52*b*R (more specifically, the force detection values after subjected to the filtering of the low-pass characteristic for removing noise components) to obtain a measurement value Fft_R of the right leg tread force of the user. The same processing applies to the left tread force measurement processor 70L.

In the processing by each of the tread force measurement processors 70, the tread force measurement value Fft may be forcibly set to zero in the case where the total sum of the force detection values obtained by corresponding tread force measurement sensors 52*a* and 52*b*, respectively, is an extremely small value of a predetermined lower limit value or less, or limit processing for forcibly setting the tread force measurement value Fft to a predetermined upper limit value in the case where the total sum exceeds the upper limit value may be added. According to the present embodiment, as will be discussed later, the proportions of the target leg link share values Fcmd_R and Fcmd_L are basically determined on the basis of the proportions of the right leg tread force measurement value Fft_R and the left leg tread force measurement value Fft_L of the user. Hence, adding the limit processing to the processing implemented by each of the tread force measurement processors 70 is effective for restraining frequent fluctuations in the proportions of target leg link share values Fcmd_R and Fcmd_L.

The processing by the knee angle measurement processors 71R and 71L is carried out as described below. The same processing algorithm applies to both knee angle measurement processors 71R and 71L. The processing by the right knee angle measurement processor 71R will be representatively described. The right knee angle measurement processor 71R determines a provisional measurement value of the knee angle of the leg link 3R from the rotational angle of the output shaft 16*a*R or the rotor of the electric motor 16 indicated by an output of the angle sensor 54R according to a preset arithmetic expression or a data table (an arithmetic expression or a data table indicating the relationship between the rotational angle and the knee angle of the leg link 3R). Then, the right knee angle measurement processor 71R subjects the provisional measurement value to the filtering of the low-pass characteristic for removing noise components therefrom so as to obtain the knee angle measurement value θ1_R of the leg link 3R. The same processing applies to the left knee angle measurement processor 71L.

The knee angle θ1 measured by each of the knee angle measurement processors 71R and 71L denotes the flexion degree of each of the leg links 3. In the present embodiment, therefore, the knee angle measurement processors 71R and 71L function as the flexion degree measuring devices in the present invention.

Supplementally, the knee angle measured by each of the knee angle measurement processors 71 is the angle θ1 shown in FIG. 5. The supplementary angle (=180°−θ1) of the angle θ1 may be measured as the index indicative of the flexion degree of the leg link 3. Alternatively, for example, the angle θ4 formed by the straight line L6 connecting the third joint 8 and the swing shaft 19 of the leg link 3 and the straight line L2 connecting the third joint 8 and the second joint 6 of the leg link 3 when the leg link 3 is observed in the direction of the joint axis of the third joint 3 may be measured as the index indicative of the flexion degree of the leg link 3.

The processing by the rod transmission force measurement processors 72R and 72L is carried out as follows. The same processing algorithm applies to both rod transmission force measurement processors 72R and 72L. The following will representatively describe the processing by the right rod transmission force measurement processor 72R. The right rod transmission force measurement processor 72R converts the voltage value of an output of the strain gauge force sensor 53R, which has been received, into a rod transmission force measurement value Frod_R according to a preset arithmetic expression or a data table (an arithmetic expression or a data table indicating the relationship between the output voltage and the rod transmission force). The same applies to the processing by the right rod transmission force measurement processor 72R. In this case, the output value of the strain gauge force sensor 53 or the measurement value of each rod transmission force Frod may be subjected to the filtering of a low-pass characteristic to remove noise components therefrom.

Subsequently, the arithmetic processor 61 carries out the processing of the target right/left share determiner 73. This processing will be described in detail with reference to FIG. 11 and FIG. 12.

First, right and left allotment ratio calculation processing is carried out in S101. The right and left allotment ratio calculation processing determines a right allotment ratio, which is the ratio of a target value of a right leg link share with respect to a target value of the total lifting force the borne-by-assistance-device support force), and a left allotment ratio, which is the ratio of a target value of a left leg link share with respect to the target value of the total lifting force. The total sum of the right allotment ratio and the left allotment ratio is 1.

Figure 12:
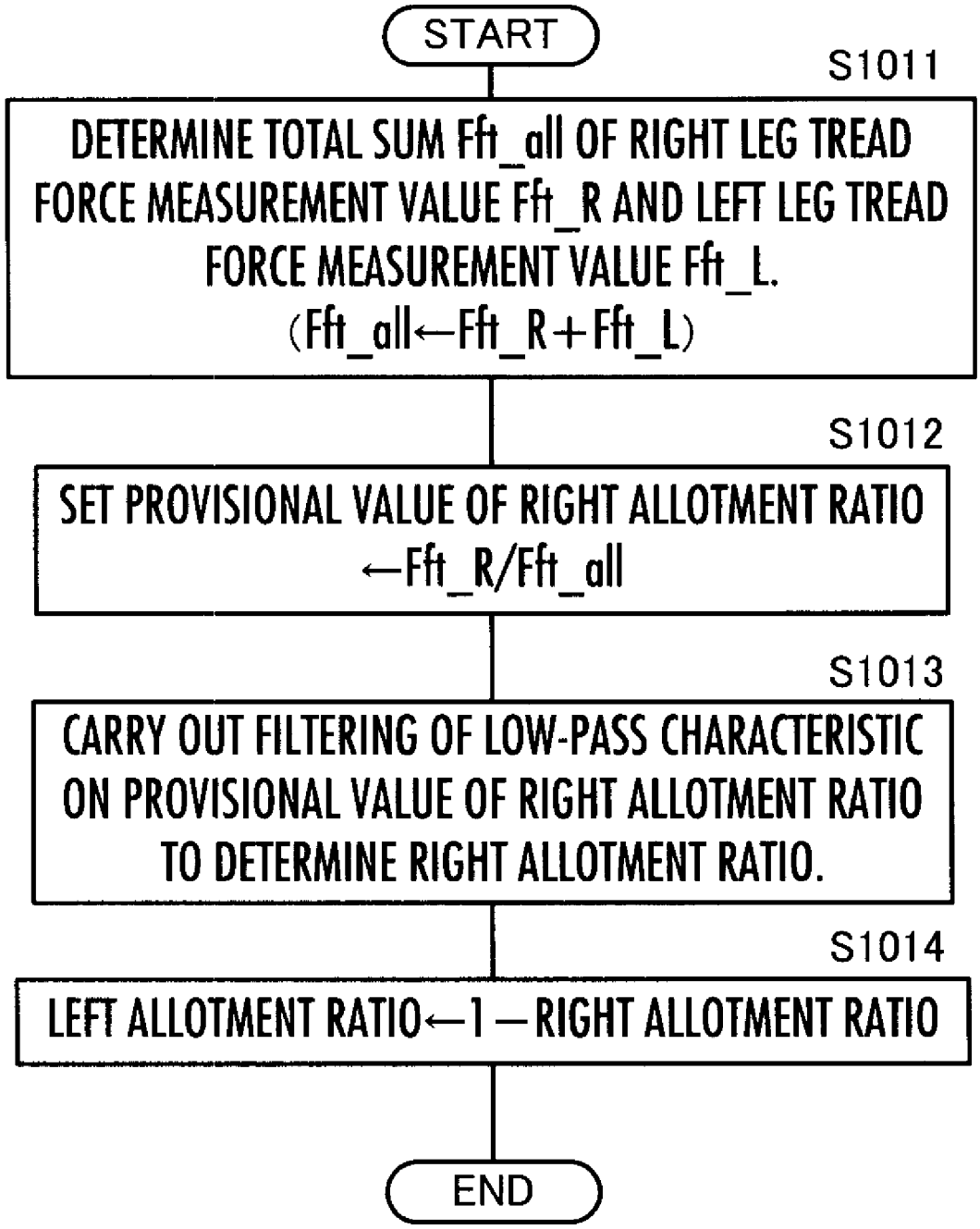
FIG. 12 is a flowchart illustrating the processing in S101 in FIG. 11.
Figure 13:
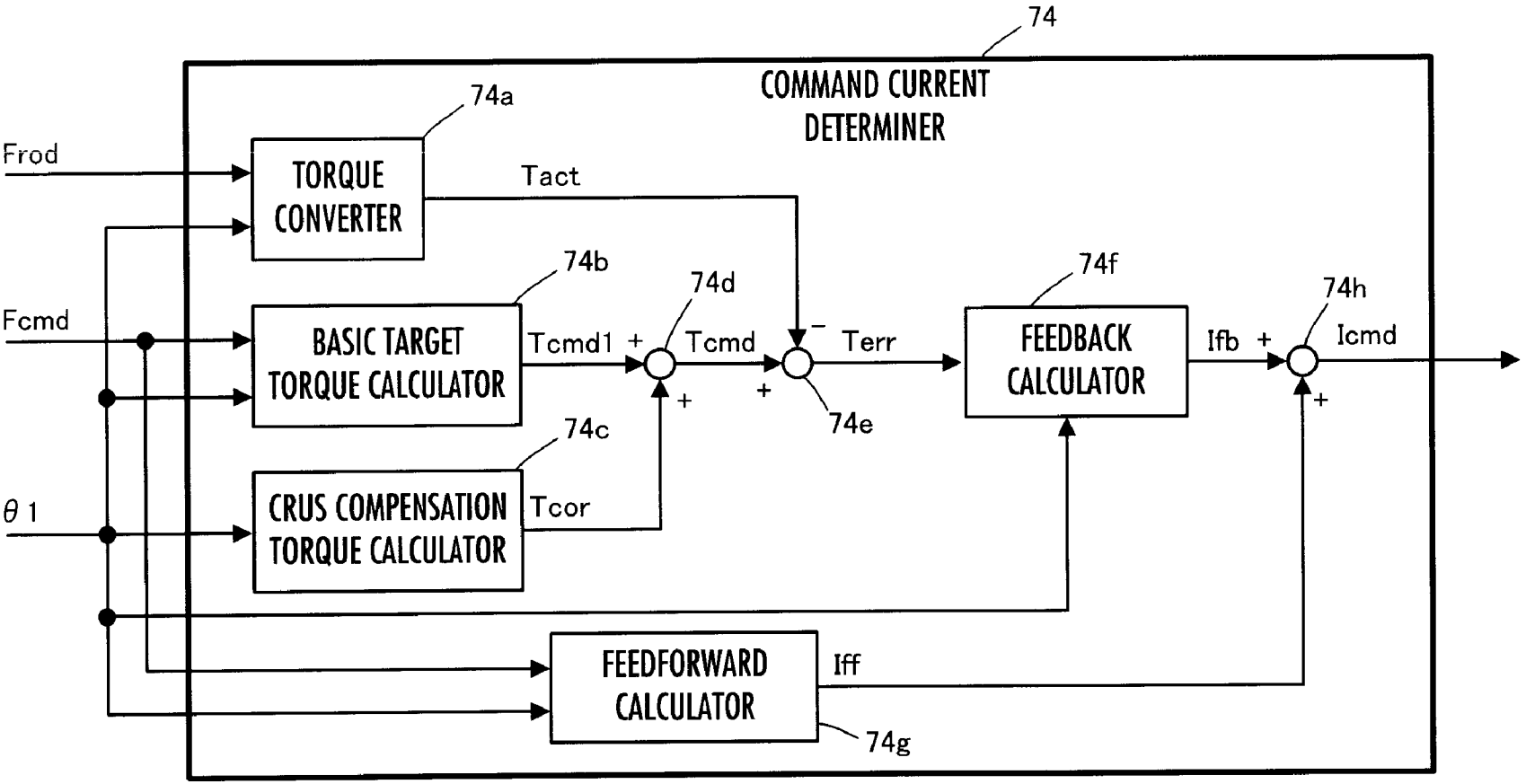
FIG. 13 is a block diagram illustrating the processing by a command current determiner provided in the arithmetic processor in FIG. 10.

The right and left allotment ratio calculation processing is carried out as illustrated by the flowchart of FIG. 12. First, in S1011, a total sum Fft_all of the right Leg tread force measurement value Fft_R and the left leg tread force measurement value Fft_L determined by the tread force measurement processors 70R and 70L, respectively, (=Fft_R+Fft_L) is calculated.

Subsequently, in S1012, a value Fft_R/Fft_all obtained by dividing the right leg tread force measurement value Fft_R by Fft_all is set as a provisional value of the right allotment ratio.

Subsequently, in S1013, the provisional value of the right allotment ratio is subjected to the filtering of the low-pass characteristic thereby to determine a final right allotment ratio (the right allotment ratio in the current control processing cycle). Further, in S1014, the right allotment ratio determined as described above is subtracted from 1 to determine the left allotment ratio. The filtering in S1013 is the processing for restraining an abrupt change in the right allotment ratio (and eventually an abrupt change in the left allotment ratio).

Supplementally, instead of determining the provisional value of the right allotment ratio in S1012, the provisional value of the left allotment ratio may be determined and the provisional value may be subjected to the filtering of the low-pass characteristic so as to determine the obtained result as the left allotment ratio. Then, the left allotment ratio thus determined may be subtracted from 1 thereby to determine the right allotment ratio. In this case, a value Fft_L/Fft_all obtained by dividing the left leg tread force measurement value Fft_L by Fft_all may be determined as the provisional value of the left allotment ratio in S1012.

Figure 11:
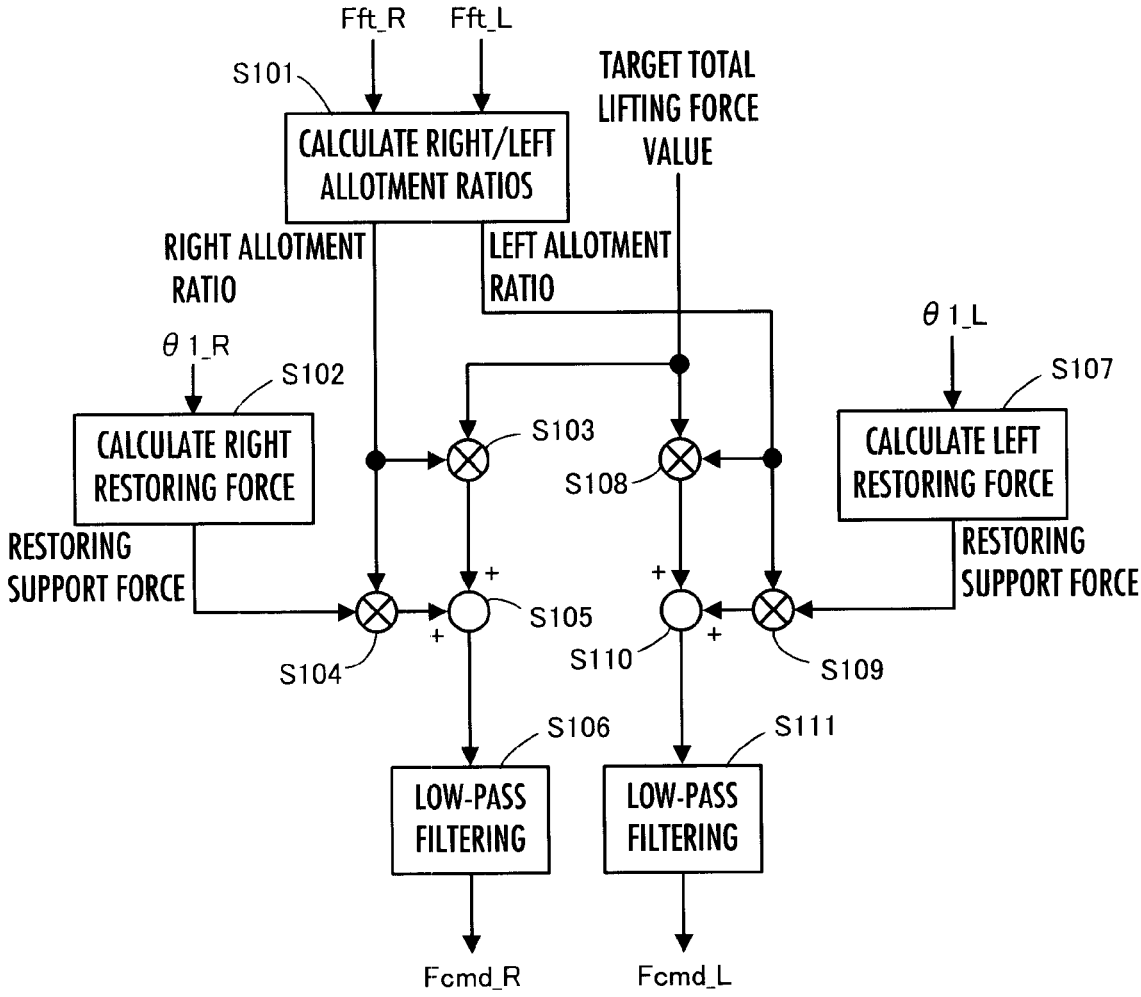
FIG. 11 is a block diagram illustrating the processing of a target right/left share determiner provided in the arithmetic processor in FIG. 10.

Referring to FIG. 11, after determining the right allotment ratio and the left allotment ratio as described above, the target right/left share determiner 73 carries out the processing of S102 and S107. The processing of these steps S102 and S107 may be carried out in parallel with or before S101.

The processing in S102 determines the support force to be additionally applied to the right leg link 3R to restore (or bring) the flexion degree of the right leg link R3 to (or close to) a predetermined flexion degree in the case where the flexion degree of the right leg link 3R is larger than the predetermined flexion degree. Similarly, the processing in S107 determines the support force to be additionally applied to the left leg link 3L so as to restore (or bring) the flexion degree of the left leg link 3L to (or close to) a predetermined flexion degree in the case where the knee angle of the left leg link 3L is larger than a predetermined value (the flexion degree of the left leg link 3L is larger than a predetermined flexion degree). Hereinafter, these support forces will be referred to as "the restoring support forces."

The processing in S102 and the processing of S107 share the same algorithm, so that the processing in S102 related to the right leg link 3R will be representatively described with reference to FIG. 5.

The processing in S102 first uses a knee angle measurement value θ1_R of the leg link 3R determined by the right knee angle measurement processor 71R to calculate a distance D3 between a curvature center 4*a*R and a second joint 6R according to expression (2) given above. Then, in the case where the difference between the calculated distance D3 and a predetermined reference value DS3 (the target value of D3), the difference being expressed by (DS3−D), is a positive value, the difference is multiplied by a predetermined gain k (>0) corresponding to a spring constant to calculate the restoring support force. In the case where the difference (DS3−D3) is zero or a negative value, the restoring support force is determined to be zero regardless of the value of the difference (DS3−D3). In other words, the restoring support force is determined according to expression (4a) or (4b) given below.

In the case where DS3>D3

$$\text{Restoring support force}=k\cdot(DS3-D3) \tag{4a}$$

In the case where DS3≦D3

$$\text{Restoring support force} \tag{4b}$$

The processing in S107 related to the left leg link 3L is carried out in the same manner. The restoring support force of each of the leg links 3 determined as described above is the support force to be additionally applied to the leg link 3 so as to restore (or bring) the flexion degree of the leg link 3 to (or close to) a predetermined flexion degree in the case where the flexion degree of the leg link 3 is larger than a predetermined flexion degree at which the distance D3 agrees with the reference value DS3. According to the present embodiment, the predetermined flexion degree at which the distance D3 agrees with the reference value DS3 is set to, for example, a flexion degree that is approximately the same as a maximum flexion degree of each of the leg links 3 that is implemented while the user is in the normal walking mode on a level ground. Hence, the restoring support force is basically set to zero when the user is in the normal walking node on a level ground. In the case where the user deeply bends his/her both legs to squat, the additional restoring support force is generated.

In the present embodiment, the restoring support force is determined on the basis of the difference between the reference value DS3 and the distance D3. Alternatively, however, the restoring support force may be determined on the basis of the difference between the knee angle measurement value θ1 and the value of the knee angle θ1 corresponding to the reference value DS3. Further alternatively, the restoring support force may be determined on the basis of the difference between the distance between the straight line L3 connecting the curvature center 4*a* and the second joint 6 and the third joint 3 (=D2·sin θ2) and a reference value for the distance.

After carrying out the processing in S102 and S107 as described above, the target right/left share determiner 73 carries out the processing of S103 to S106 related to the right leg link 3R and the processing of S108 to S111 related to the left leg link 3L. In the processing of S103 to S106 related to the right leg link 3R, first, in S103, the target value of the total lifting force is multiplied by the right allotment ratio determined in S101. Thus, the reference value of the target leg link share value of the right lea link 3R is determined.

Here, according to the present embodiment, the target value of a total lifting force is set beforehand as described below and stored in a memory, which is not shown. For example, the magnitude of the gravity acting on the weight obtained by adding up the weight of the entire walking assistance device A (or the weight obtained by subtracting the total weight of both foot-worn portions 2 and 2 from the weight of the entire walking assistance device A) and the weight of a part of the weight of the user to be supported by the lifting force acting on the user from the seating portion 1 (e.g., the weight obtained by multiplying the entire weight of the user by a preset ratio), which is expressed by the weight multiplied by a gravitational acceleration, is set as the target value of the total lifting force. In this case, an upward translational force of a magnitude equivalent to the gravity acting on the weight of a part of the body weight of the user is eventually set as a target lifting force applied from the seating portion 1 to the user.

Alternatively, the magnitude of a target lifting force applied from the seating portion 1 to the user may be directly set, and the total sum of the magnitudes of the target lifting force and the gravity acting on the total weight of the walking assistance device A (or the weight obtained by subtracting the total weight of both foot-worn portions 2 and 2 from the total weight of the walking assistance device A) may be set as the target value of the total Lifting force. Further, in the case where a vertical inertial force generated by a motion of the walking assistance device A is relatively large as compared with the aforesaid gravity, the magnitude of the total sum of the inertial force and the gravity may be set as the target value of the total lifting force. In this case, the inertial force is required to be sequentially estimated. The estimation may be accomplished by using a publicly known technique, such as the technique proposed by the present applicant in Japanese Patent Application Laid-Open No. 2007-330299.

Further, in S104, the restoring support force determined in S102 is multiplied by the right allotment ratio. Then, the value of the multiplication result is added to the basic value of the leg link share target value of the right leg link 3R in S105. Thus, the provisional value of the leg link share target value of the right leg link 3R is determined. Then, the filtering of the low-pass characteristic is carried out on the provisional value in S106 thereby to finally determine the target leg link share value Fcmd_R of the right leg link 3R. The filtering in S106 is implemented to remove noise components attributable mainly to fluctuations in the knee angle of the leg link 3R.

Similarly, in the processing in S108 to S111 related to the left leg link 3L, first, in S108, the target value of the total lifting force is multiplied by the left allotment ratio determined in S101. Thus, the basic value of the target leg link share value of the left leg link 3L is determined. Further, in S109, the restoring support force determined in S107 is multiplied by the left allotment ratio. Then, the value of the multiplication result is added to the basic value of the target leg link share value of the left leg link 3L in S110. Thus, the provisional value of the target leg link share value of the left leg link 3L is determined. Then, the filtering of the low-pass characteristic is carried out on the provisional value in S111 thereby to finally determine the target leg link share value Fcmd_L of the left leg link 3L. The filtering in S111 is implemented to remove noise components attributable mainly to fluctuations in the knee angle of the leg link 3L.

The above has described the processing by the target right/left share determiner 73. By this processing, the right/left target share determiner 73 determines the target right leg link share value Fcmd_R and the target left leg link share value Fcmd_L such that the proportions (ratio) thereof agrees with the ratio of the right allotment proportion and the left allotment proportion (the ratio between Fft_R and Fft_L) determined on the basis of the right leg tread force measurement value Fft_R and the left leg tread force measurement value Fft_L of the user in the case where the flexion degrees of both leg links 3R and 3L are scalier than a predetermined flexion degree (a flexion degree corresponding to the reference value DS3) when, for example, the user is walking on a level ground. In this case, the total sum of the right and left target leg link share values Fcmd_R and Fcmd_L is determined to agree with the target value of a total lifting force. In other words, the target leg link share values Fcmd_R and Fcmd_L are determined such that a target lifting force is applied from the seating portion 1 to the user.

In a situation wherein the flexion degrees of the leg links 3R and 3L are larger than the predetermined flexion degree (the flexion degree corresponding to the reference value DS3, the restoring support force is added to the target leg link share values Fcmd_R and Fcmd_L, respectively. More specifically, a support force for causing the leg links 3R and 3L to stretch to a predetermined flexion degree is added to the total sum of the target leg link share values Fcmd_R and Fcmd_L. In this case, the target lifting force applied from the seating portion 1 to the user is eventually set to be larger than the lifting force corresponding to the target value of the total lifting force. Further, the target lifting force will be set such that the target lifting force increases as the flexion degrees of the leg links 3R and 3L increase.

In the state wherein the knee angles θ1 of both leg links 3 and 3 are equal to each other with both legs evenly in contact with the ground, the right allotment ratio and the left allotment ratio will be substantially the same and the right and left restoring support forces will be also substantially the same. Accordingly, the magnitudes of the target right and left leg link share values Fcmd_R and Fcmd_L will be substantially equal to each other.

After carrying the processing by the target right/left lifting force determiner 73 as described above, the arithmetic processor 61 carries out the processing by the command current determiners 74R and 74L. The same processing algorithm applies to both command current determiners 74R and 74L. The following will representatively describe the processing by the right command current determiner 74R with reference to FIG. 13. FIG. 13 is a block diagram illustrating the functional devices of the right command current determiner 74R. In the description of the processing by the right command current determiner 74R, the suffixes "R" and "L" of reference numerals will be omitted. Unless otherwise specified, the reference numerals will relate to the right leg link 3R (the suffix "R" being omitted).

The right command current determiner 74R has a torque converter 74*a* which converts the rod transmission force measurement value Frod obtained by the right rod transmission force measurement processor 72 into a drive torque value Tact to be actually imparted to the third joint 3 on the basis of the measurement value Frod (hereinafter referred to as the actual joint torque Tact), a basic target torque calculator 74*b* which determines a basic target torque Tcmd1, which is the basic value of a target value of a drive torque to be imparted to the third joint 8 on the basis of the target right leg link share value Fond determined by the target right/left share determiner 73, and a crus compensation torque calculator 74*c* which determines a torque Tcor to be additionally imparted to the third joint 8 in order to compensate for a influence of a frictional force or the like generated due to a rotational motion of the lower link member 7 relative to the upper link member 5 when the third joint 8 is driven (hereinafter referred to as "the crus compensation torque Tcor").

The right command current determiner 74R further includes an addition calculator 74*d* which determines a target joint torque Tcmd as a final (in a current control processing cycle) target value of the torque to be imparted to the third joint 8 by adding the crus compensation torque Tcor determined by the crus compensation torque calculator 74*c* to the basic target torque Tcmd1 determined by the basic target torque calculator 74*b*, a subtraction calculator 74*e* which determines a difference Terr (=Tcmd−Tact) between the target joint torque Tcmd and the actual joint torque Tact determined by the torque converter 74*a*, a feedback calculator 74*f* which determines a feedback manipulated variable Ifb of a command current value of the electric motor 16 required to set the difference Terr to zero, i.e., to make Tact agree with Tcmd, a feedforward calculator 74*g* which determines a feedforward manipulated variable Iff of the command current value of the electric motor 16 required to cause an actual total lifting force share of the right leg link 3 to become a target leg link share value, and an addition calculator 74*h* which determines a final command current value Icmd by adding the feedback manipulated variable Ifb and the feedforward manipulated variable Iff. The target joint torque Tcmd indicates the target value of the total sum of the drive torque imparted to the third joint 8 from the electric motor 16 and the urging torque (spring torque) imparted to the third joint 8 from the coil spring 40.

Then, the right command current determiner 74 first carries out the processing by the torque converter 74*a*, the basic target torque calculator 74*b*, and the crus compensation torque calculator 74*c* as described below.

The torque converter 74*a* receives the rod transmission force measurement value Frod of the connecting rod 31 of the right motive power transmission mechanism 15 and the knee angle measurement value θ1 of the right leg link 3.

Here, the distance between the third joint 8 and the pivot pin 33 of the crank arm 30 in the direction orthogonal to the direction of the axial center of the connecting rod 31 (the direction of the axial center of the linear-motion output shaft 14*a*) is denoted by r. At this time, the value obtained by multiplying the rod transmission force measurement value Frod by the distance r (hereinafter referred to as "the effective radius length r") indicates the actual joint torque Tact. The effective radius length r is determined on the basis of the knee angle of the right leg link 3. Then, the torque converter 74*a* determines the effective radius length r from the input knee angle measurement value θ1 according to a preset arithmetic expression or a data table (an arithmetic expression or a data table indicating the relationship between the knee angle and the effective radius length). The torque converter 74*a* then multiplies the determined effective radius length r by the input rod transmission force measurement value Frod to determine the actual joint torque Tact imparted to the third joint 8.

The processing by the torque converter 74*a* is, in other words, arithmetic processing for calculating the vector product (exterior product) of the vector of a rod transmission force and the positional vector of the pivot pin 33 (the pivotally installed portion of the connecting rod 31) of the crank arm 30 with respect to the joint axis of the third joint 8.

Supplementally, according to the present embodiment, the torque imparted to the third joint 8 by the rod transmission force is used as the amount to be controlled in the present invention. Hence, the actual joint torque Tact determined by the torque converter 74*a* as described above corresponds to a measurement value of the amount to be controlled. Further, in the present embodiment, for each leg link 3, the rod transmission force measurement processor 72 and the torque converter 74*a* together implement the device for measuring an amount to be controlled in the present invention.

The basic target torque calculator 74*b* receives the target right leg link share value Fcmd determined by the target right/left share determiner 73 and the knee angle measurement value θ1 of the right leg link 3. Based on these input values, the basic target torque calculator 74*b* determines the basic target torque Tcmd1 as described below. This processing will be described below with reference to FIG. 5.

Referring to FIG. 5, the support force acting on the leg link 3 from a floor through the intermediary of the second joint 6 can be regarded as a translational force toward the curvature center 4*a* of the guide rail 11 from the second joint 6. The target value of the magnitude of the translational force becomes the target leg link share value Fcmd. Further, in the case where it is assumed that a translational force (support force) having the magnitude of the target leg link share value Fcmd is applied to the leg link 3 from a floor, the torque that balances out a moment generated around the joint axis of the third joint 8 by the vector of the translational force is the basic target torque Tcmd1 that should be obtained.

Here, the relationship indicated by the following expression (5), which uses the angle θ2 and the distance D2, holds between the target leg link share value Fcmd and the basic target torque Tcmd1.

$$Tcmd1=(Fcmd\cdot\sin\theta 2)\cdot D2 \quad (5)$$

The right side of expression (5) indicates the magnitude of a moment generated about the joint axis of the third joint 8 by the vector of the translational force in the case where it is assumed that the translational force (support force) having the magnitude of the target leg link share value Fcmd has been applied to the leg link 3 from the floor.

Therefore, the basic target torque calculator 74*b* determines the basic target torque Tcmd1 according to expression (5). In this case, the value of D2 required for the calculation of the right side of expression (5) is a fixed value and stored in a memory (not shown) beforehand. The angle θ2 is calculated from the values of the intervals D1 and D2 stored in a memory (not shown) beforehand and the knee angle measurement value θ1 according to the aforesaid expressions (2) and (3).

The above has described the processing by the basic target torque calculator 74*b*.

Supplementally, the basic target torque Tcmd1 corresponds to the target value of an amount to be controlled in the present invention. According to the present embodiment, therefore, the basic target torque calculator 74*b* implements the target value determiner in the present invention.

The knee angle measurement value θ1 of the right leg link 3 is input to the crus compensation torque calculator 74*c*. Then, the crus compensation torque calculator 74*c* uses the input measurement value θ1 to perform the computation of a model expression of expression (6) given below, thereby calculating the crus compensation torque Tcor.

$$Tcor=A1\cdot\theta 1+A2\cdot\mathrm{sgn}(\omega 1)+A3\cdot\omega 1+A4\cdot\beta 1+A5\cdot\sin(\theta 1/2) \quad (6)$$

Here, ω1 in the right side of expression (6) denotes a knee angular velocity as a temporal change rate (differential value) of the knee angle of the right leg link 3, β1 denotes a knee angular acceleration as a temporal change rate (differential value) of the knee angular velocity ω1, and sgn( ) denotes a sign function. Further, A1, A2, A3, A4, and A5 are the coefficients of values that have been determined beforehand.

The first term of the right side of expression (6) is a term for reducing the target joint torque Tcmd in the stretching direction of the leg link 3 from the basic target torque Tcmd1 by the magnitude of a spring torque imparted by the coil spring 40 of the right leg link 3.

Further, the second term of the right side means a torque to be imparted to the third joint 8 to drive the third joint 8 against a resistance force generated in the third joint 8 due to a frictional force (dynamic frictional force) between the upper link member 5 and the lower link member 7 at the third joint 8 of the right leg link 3.

Further, the third term of the right side means a torque to be imparted to the third joint 8 to drive the third joint 8 against a viscous resistance between the upper link member 5 and the lower link member 7 at the third joint 8 of the right leg link 3, i.e., a viscous resistance force generated on the basis of the knee angular velocity col.

Further, the fourth term of the right side means a torque to be imparted to the third joint 8 to drive the third joint 8 against an inertial force moment generated on the basis of the knee angular acceleration β1, more specifically, the moment of a resistance force generated at the third joint 8 due to an inertial force caused by a motion of a portion closer to the foot-worn portion 2 than to the third joint 8 (a portion composed of the lower link member 7, the second joint 6, and the foot-worn portion 2) of the right leg link 3.

Further, the fifth term of the right side means a torque to be imparted to the third joint 8 to drive the third joint 8 against the moment of a resistance force generated at the third joint 8 due to the gravity acting on the portion closer to the foot-worn portion 2 than to the third joint 8 (a portion composed of the lower link member 7, the second joint 6, and the foot-worn portion 2) of the right leg link 3.

The angle to which the sine function sin( ) in the fifth term should be applied is basically an angle formed by the straight line L2 (the straight line connecting the third joint 8 and the second joint 6) in FIG. 5 and the vertical direction (the direction of gravity). In the present embodiment, the length of the upper link member 5 and the length of the lower link member 7 are about the same, so that the angle formed by the straight line L2 and the vertical direction is approximately half the knee angle of the leg link 3 measured by the knee angle measurement processor 71. In the present embodiment, therefore, the angle to which the sine function sin( ) in the fifth term is to be applied is defined as "θ1/2." However, in the case where an acceleration sensor or a tilt meter is installed to the walking assistance device A to permit the detection of a tilt angle of the lower link member 7 (the tilt angle of the straight line L2) relative to the direction of gravity, the tilt angle is desirably used in place of the "θ1/2" in the fifth term.

To perform the computation of the right side of the aforesaid expression (6), the crus compensation torque calculator 74*c* sequentially calculates the value of the knee angular velocity ω1 and the value of the knee angular acceleration β1 required for the computation from the time series of the knee angle measurement value θ1 of the right leg link 3 sequentially input from the right knee angle measurement processor 71. Then, the crus compensation torque calculator 74*c* performs the computation of the right side of expression (6) by using the input knee angle measurement value θ1 (the current value) of the right leg link 3, the calculated value of the knee angular velocity (the current value), and the calculated value of the knee angular acceleration β1 (the current value) so as to calculate the crus compensation torque Tcor. The term "a current value" means the value determined in the present control processing cycle of the arithmetic processor 61.

Supplementally, the values of the coefficients A1, A2, A3, A4, and A5 used for the computation of expression (6) are experimentally identified beforehand by an identification algorithm for minimizing the square value of the difference between the value of the left side (an actually measured value) and the value of the right side (a computed value) of expression (6), and stored in a memory (not shown).

The above has described the processing by the crus compensation torque calculator 74*c*. Thus, the crus compensation torque Tcor determined by the crus compensation torque calculator 74*c* means an additional compensation amount for correcting the basic target torque Tcmd1.

Supplementally, the second term among the terms of the right side of expression (6) generally takes a relatively small value, as compared with other terms, so that the second term may be omitted. Alternatively, the crus compensation torque Tcor may be determined by a model expression which omits one of the third term, the fourth term, and the fifth term of the right side of expression (6), the one taking a value relatively smaller than the remaining terms. For example, if the foot-worn portion 2 is sufficiently lighter than the third joint 8 of the right leg link 3, then both or one of the fourth term and the fifth term may be omitted.

After carrying out the processing by the torque converter 74*a*, the basic target torque calculator 74*b*, and the crus compensation torque calculator 74*c* as described above, the right command current determiner 74 carries out the processing by the addition calculator 74*d*. This processing adds up the basic target torque Tcmd1 and the crus compensation torque Tcor, which have been determined by the basic target torque calculator 74*b* and the crus compensation torque calculator 74*c*, respectively. In other words, the basic target torque Tcmd1 is corrected on the basis of the crus compensation torque Tcor. Thus, the target joint torque Tcmd (=Tcmd1+Tcor) is calculated.

The target joint torque Tcmd calculated as described above is the target value of the torque required to impart to the third joint 8 so as to cause a target lifting force to act from the seating portion 1 to the user.

The right command current determiner 74 further carries out the processing by the subtraction calculator 74*e*. This processing subtracts the actual joint torque Tact determined by the torque converter 74*a* from the target joint torque Tcmd determined by the addition calculator 74*d* thereby to calculate the difference Terr between Tcmd and Tact (=Tcmd−Tact).

Subsequently, the right command current determiner 74 carries out the processing by the feedback calculator 74*f*. At this time, the difference Terr is input to the feedback calculator 74*f*. Then, the feedback calculator 74*f* calculates, from the input difference Terr, a feedback manipulated variable Ifb as a feedback component of the command current value Icmd by a predetermined feedback control law. As the feedback control law, a PD law (a proportion-derivative law), for example, is used. In this case, the result obtained by multiplying the difference Terr by a predetermined gain Kp (a proportional term) and a differential value (a differential term) obtained by multiplying the difference Terr by a predetermined gain Kd are added to calculate the feedback manipulated variable Ifb. In the present embodiment, the sensitivity to a change in the lifting force of the seating portion 1 in response to a current change (a change in an output torque) of the electric motor 16 changes according to the knee angle of the leg link 3. According to the present embodiment, therefore, the knee angle measurement value θ1 of the right leg link 3 in addition to the difference Terr is input to the feedback calculator 74*f*. Then, the feedback calculator 74*f* variably sets the values of the gains Kp and Kd of the proportional term and the differential term mentioned above on the basis of the knee angle measurement value θ1 of the right leg link 3 according to a data table (not shown), which has been established beforehand, the data table indicating the relationship between the knee angle and the gains Kp and Kd.

Supplementally, according to the present embodiment, the crus compensation torque calculator 74*c*, the addition calculator 74*d*, the subtraction calculator 74*e*, and the feedback calculator 74*f* together implement the feedback manipulated variable determiner in the present invention. The present embodiment has the crus compensation torque calculator 74*c*. Alternatively, however, the crus compensation torque calculator 74*c* may be omitted. In this case, the addition calculator 74*d* may be also omitted, and the basic target torque Tcmd1 in place of the target joint torque Tcmd may be input to the subtraction calculator 74*e*.

Meanwhile, the right command current determiner 74 carries cut the processing by the feedforward calculator 74*g* concurrently with the processing by the feedback calculator 74*f*. In this case, the feedforward calculator 74*g* receives the target right leg link share value Fcmd determined by the target right/left share determiner 73 and the knee angle measurement value θ1 of the right leg link 3.

The feedforward calculator 74*g* calculates a feedforward manipulated variable Iff as a feedforward component of a command current value of the electric motor 16 by a model expression indicated by an expression (7) given below.

$$Iff=B1\cdot Tcmd1+B2\cdot\omega1+B3\cdot\mathrm{sgn}(\omega1)+B4+\beta1+B5+\theta1 \quad (7)$$

Here, Tcmd1 in the right side of expression (7) is identical to the basic target torque Tcmd1 determined by the basic target torque calculator 74*b*. Further, ω1 and β1 denote a knee angular velocity and knee angular acceleration, respectively, as described in relation to the aforesaid expression (6). Further, B1, B2, B3, B4, and B5 denote coefficients of predetermined values.

The first term of the right side of expression (7) denotes a component determined on the basis of Tcmd1. More specifically, the first term of the right side of expression (7) means a basic required value of an energizing current of the electric motor 16 required to impart a torque that balances out a moment generated about the third joint 8, i.e., the basic target torque Tcmd1, to the third joint 8 of the right leg link 3 in the case where it is assumed that a support force of the target right leg link share value Fcmd is applied from a floor to the right leg link 3. The second term of the right side means a component of the energizing current of the electric motor 16 required to impart a torque against a viscous resistance between the upper link member 5 and the lower link member 7 at the third joint 8 of the right leg link 3, i.e., a torque against the viscous resistance force generated on the basis of the knee angular velocity ω1, to the third joint 8.

The third term of the right side means a component of the energizing current of the electric motor 16 required to impart a torque against a dynamic frictional force between the upper link member 5 and the lower link member 7 at the third joint 8 of the right leg link 3 to the third joint 8.

The fourth term of the right side means a component of the energizing current of the electric motor 16 required to impart a torque against an inertial force moment generated on the basis of the knee angular acceleration β1 to the third joint 8.

The fifth term of the right side is a term for reducing the energizing current of the electric motor 16 generating a torque in the direction, in which the leg link 3 stretches, by the magnitude of a spring torque produced by the coil spring 40 of the right leg link 3. Hence, the fifth term is a component determined such that the component changes depending on the spring torque.

In this case, as with the processing by the crus compensation torque calculator 74*c*, the feedforward calculator 74*g* calculates ω1 and β1 required for the arithmetic computation of the right side of expression (7) from the time series of the knee angle measurement value θ1 of the right leg link 3 that is input. Further, according to the same arithmetic processing as that of the basic target torque calculator 74*b*, the feedforward calculator 74*g* calculates the basic target torque Tcmd1 required for the arithmetic computation of the right side of expression (7) from the target right leg link share value Fcmd and the knee angle measurement value θ1 that are received.

Then, the feedforward calculator 74*g* uses the input knee angle measurement value θ1 (the current value) of the right leg link 3, the calculated value (the current value) the knee angular velocity ω1, the value (the current value) of the knee angular acceleration [3], and the calculated value (the current value) of the basic target torque Tcmd1 to perform the arithmetic computation of the right side of expression (7), thereby calculating the feedforward manipulated variable Iff.

Supplementally, the values of the coefficients B1, B2, B3, B4, and B5 used for the arithmetic computation of expression (7) are experimentally identified beforehand by an identification algorithm for minimizing the square value of the difference between the value of the left side (an actually measured value) and the value of the right side (a computed value) of expression (7), and stored in a memory (not shown). The feedforward manipulated variable Iff may be determined by a model expression which omits, for example, the second term or the fourth term among the terms of the right side of expression (5). Further, instead of inputting the target leg link share value Fcmd, the basic target torque Tcmd1 calculated by the basic target torque calculator 74*b* may be input to the feedforward calculator 74*g*. In this case, there is no need to calculate Tcmd1 by the feedforward calculator 74*g*.

In the present embodiment, the feedforward manipulated variable determiner in the present invention is implemented by the feedforward calculator 74*g*.

After carrying out the processing by the feedback calculator 74*f* and the feedforward calculator 74*g* as described above, the command current determiner 74 carries out the processing by the addition calculator 74*h*. This processing adds up the feedback manipulated variable Ifb and the feedforward manipulated variable Iff determined by the feedback calculator 74*f* and the feedforward calculator 74*g*, respectively. Thus, the command current value Icmd of the right electric motor 16 as the resultant manipulated variable of the feedback manipulated variable Ifb and the feedforward manipulated variable Iff is calculated.

The above has described in detail the processing by the right command current determiner 74R. The same processing applies to the left command current determiner 74L.

The arithmetic processor 61 outputs the command current values Icmd_R and Icmd_L determined by the command current determiners 74R and 74L, respectively, as described above to driver circuits 62R and 62L associated with the electric motors 16R and 16L, respectively. At this time, the driver circuits 62 energize the electric motors 16 on the basis of the received command current values Icmd.

Supplementally, in the present embodiment, the driver circuits 62 implement the actuator drivers in the present invention.

The control processing by the arithmetic processor 61 described above is carried out at a predetermined control processing cycle. Thus, the output torque of each of the electric motors 16, i.e., the drive torque imparted to the third joint 8 of each of the leg links 3 from the electric motor 16, feedback-controlled such that the actual joint torque Tact of each of the leg links 3 agrees with or converges to the target joint torque Tcmd. As a result, a target lifting force acts on the user from the seating portion 1, thereby reducing a burden on a leg of the user.

According to the present embodiment, if the knee angles θ1 of both leg links 3 and 3 are the predetermined angle θ1*a* or less (including the state wherein the user is in the upright posture) in the state wherein both legs are evenly it contact with the ground at motor off, then the borne-by-leg-link support force at motor off generated by the spring force of the coil spring 40 is substantially equal to the self-weight-bearing support force. This makes it possible to restrain the knee angle θ1 of each of the leg links 3 from changing even when the operation of the electric motor 16 is stopped in the state wherein the knee angles θ1 of both leg links 3 and 3 are the predetermined angle θ1*a* or less. This in turn makes it possible to prevent the seating portion 1 from falling. Hence, by stopping the operation of the electric motors 16 in the state wherein the user is in the upright posture or in a state wherein the user is standing in a posture close to the upright posture after using the walking assistance device A, the seating portion 1 can be easily detached from the crotch of the user without the need for the user or an attendant to support the seating portion 1 so as to prevent the seating portion 1 from falling.

when the knee angles θ1 of both leg links 3 and 3 are relatively large (when θ1>θ1*b*), the resultant torque of the spring torque produced by the coil spring 40 and the torque due to gravity turns into a torque in the direction in which the leg links 3 flex, consequently causing the borne-by-leg-link support force at motor off to be smaller than the self-weight-bearing support force. This makes it possible to steadily maintain the state wherein both leg links 3 and 3 are compactly folded to a maximum (the state wherein the knee angle θ1 is the maximum angle in the variable range) when putting away the walking assistance device A. Therefore, the walking assistance device A can be accommodated in a relatively small storage space.

Further, in the case where the knee angle θ1 lies between the predetermined angles θ1*a* and θ1*b*, the resultant torque of the spring torque and the torque due to gravity will be a torque in the direction in which the leg link 3 stretches, consequently causing the borne-by-leg-link support force at motor off to be larger than the self-weight-bearing support force. This makes it possible to restrain the output torque of the electric motor 16 to a small value in a state wherein the flexion degree of the leg link 3 becomes relatively large, which consequently causes the target torque Tcmd to be relatively large. As a result, the maximum value of the output torque required of the electric motor 16 can be restrained to be a smaller value. This in turn makes it possible to reduce the size and weight of the electric motor 16.

Further, if the knee angle θ1 is θ1*b* or less in the state wherein both legs are evenly in contact with the ground, then there is no need for the electric motors 16 and 16 to generate the motive power required for supporting the weight of the entire walking assistance device A. Hence, the power consumption of the electric motors 16 and 16 can be reduced.

In controlling the operation of the electric motors 16, the influence of a spring torque can be compensated for by including the component of the fifth term of expression (7) mentioned above in the aforesaid feedforward manipulated variable Iff, i.e., the component that is determined such that the component changes depending on the spring torque. This makes it possible to prevent an excessive change in an output torque of each of the electric motors 16 and to enable the output torque to promptly follow the target joint torque Tcmd.

Second Embodiment

A second embodiment of the present invention will now be described with reference to FIG. 14 and FIG. 15. The present embodiment differs from the first embodiment only in the construction related to the elastic member, so that the description will be focused on the different aspect. The like functional parts as those of the first embodiment will be assigned the like reference numerals as those in the first embodiment and the descriptions thereof will be omitted.

In the first embodiment, the spring constant of the coil spring 40 functioning as the elastic member (the change rate of the spring force in response to a change in the compression amount (elastic deformation amount) of the coil spring 40) has been fixed. In contrast thereto, the coil spring 40 as an elastic member in the present embodiment is constructed such that the spring constant thereof changes in two steps according to the compression amount of the coil spring 40.

More specifically, referring to FIG. 2, in the present embodiment, a portion 40*a* at one end of the entire coil spring 40 and a remaining portion 40*b* at the other end thereof have different spring constants. In the coil spring 40, for example, the material of the portion 40*a* and the material of the portion 40*b* are different, one of the materials of the portions 40*a* and 40*b* being less rigid than the other material.

Even in the case where the material of the entire coil spring 40 is uniform, it is possible to make the spring constants of the portions 40*a* and 40*b* different from each other by making the line pitch in the portion 40*a* and the line pitch in the portion 40*b* when the coil spring 40 is in the natural length thereof different from each other. Alternatively, the portion 40*a* and the portion 40*b* may differ in both the line pitch and the material.

Hereinafter, of the portions 40*a* and 40*b* of the coil spring 40, the portion having a smaller spring constant, e.g., the portion 40*a*, will be referred to as the low-spring-constant portion 40*a* and the portion 40*b* having a larger spring constant will be referred to as a high-spring-constant portion 40*b*. In the following description of the present embodiment, "the coil spring 40" will mean the coil spring in the present embodiment, which is constructed of the low-spring-constant portion 40*a* and the high-spring-constant portion 40*b*, as described above, unless otherwise specified.

As the coil spring 40 is compressed, the low-spring-constant portion 40*a* is first compressed and then the high-spring-constant portion 40*b* is compressed. Hence, in a first compression range wherein the compression amount (the elastic deformation amount) of the coil spring 40 is a predetermined value or less, the spring constant of the entire coil spring 40 will be substantially small. In a second compression range wherein the compression amount (the elastic deformation amount) exceeds the predetermined value, the spring constant of the entire coil spring 40 substantially changes to a large spring constant.

In the present embodiment, the coil spring 40 described above is installed to the upper link member 5 of each of the leg links in the same installing manner as that in the first embodiment.

Figure 14:
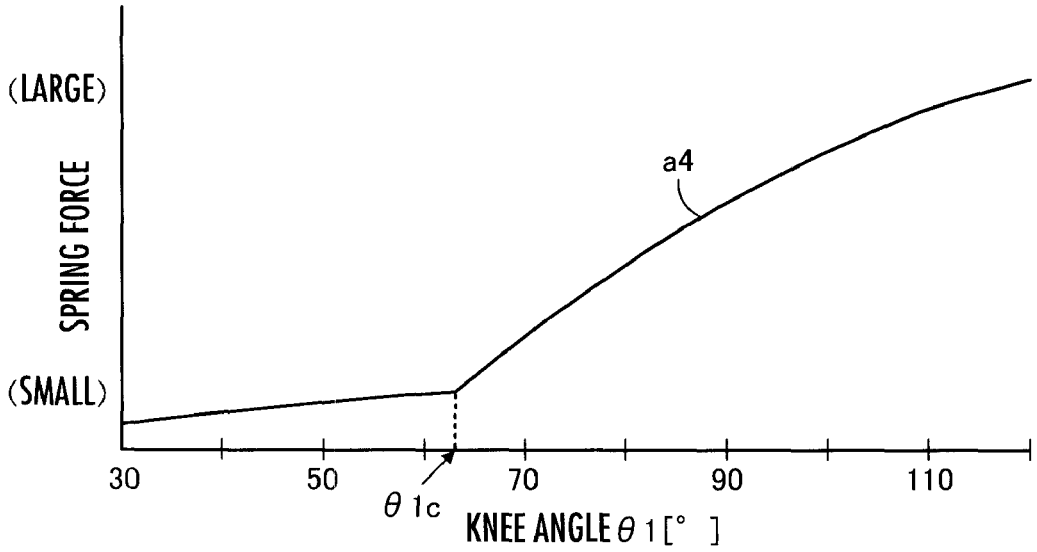
FIG. 14 is a graph illustrating the characteristic of an elastic member (coil spring) of a walking assistance device it a second embodiment.

Hence, the spring force of the coil spring 40 of each of the leg links 3 changes as indicated by a curve a4 in FIG. 14 in relation to the knee angle θ1.

More specifically, in the case where the knee angle θ1 is a predetermined angle θ1*c* or less (in the case where the compression amount of the coil spring 40 lies within the first compression range), the spring force slowly increases as the angle θ1 increases. Therefore, in the case where the relationship indicated by θ1≦θ1*c* holds, the spring force does not change much in response to a change in the angle θ1. When the knee angle θ1 exceeds the predetermined angle θ1*c* (when the compression amount of the coil spring 40 lies within the second compression range), the spring force increases as the angle θ1 increases at larger incremental steps than those in the case where the relationship θ1≦θ1*c* holds. Hereinafter, the predetermined angle θ1*c* will be referred to as the spring constant change angle θ1*c*.

In this case, according to the present embodiment, the lengths (the lengths in the natural length state) of the portions 40*a* and 40*b* of the coil spring 40 are set such that the spring constant change angle θ1*c* is approximately the same as a maximum knee angle implemented when, for example, the user is walking on a level ground, within the variable range of the knee angle θ1.

Figure 15:
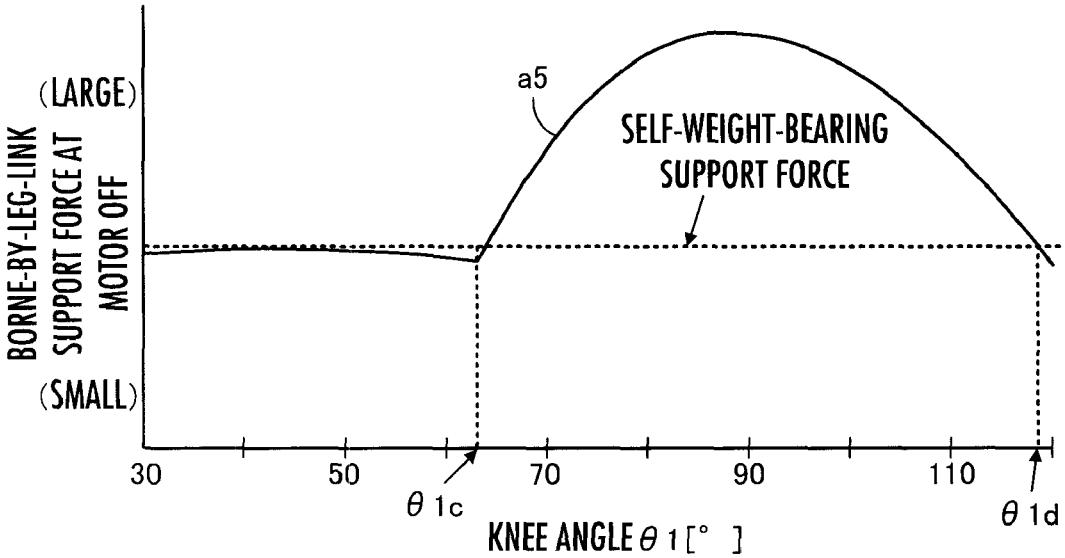
FIG. 15 is a graph illustrating the characteristic of the leg link bearing support force when a motor of the walking assistance device in the second embodiment stops.

Further, in the present embodiment, the characteristic of the spring torque relative to the knee angle θ1 in each of the leg links 3 is set such that the borne-by-leg-link support force at motor off changes as indicated by a curve a5 in FIG. 15 in relation to the knee angles θ1 of both leg links 3 and 3 in the state wherein both legs are evenly in contact with the ground at motor off.

Recording to the characteristic indicated by the curve a5 in FIG. 15, in the case where the relationship θ1≦θ1*c* holds, the borne-by-leg-link support force at motor off is maintained at a support force having a magnitude substantially equal to that of the self-weight-bearing support force. In the case where a relationship indicated by θ1<θ1*c* holds, as the knee angle θ1 increases, the borne-by-leg-link support force at motor off increases to a support force that is larger than the self-weight-bearing support force and then decreases. In this case, the spring constant in the second compression range of the coil spring 40 in the present embodiment is larger than the spring constant of the coil spring 40 in the aforesaid first embodiment. For this reason, the borne-by-leg-link support force at motor off in the case where the relationship θ1>θ1*c* holds will be a support force that is relatively larger than the self-weight-bearing support force. Further, if the angle θ1 is larger than a predetermined angle θ1*d* (>θ1*c*) close to the maximum angle in the variable range thereof (an angle corresponding to the maximum flexion degree of the leg link 3), then the borne-by-leg-link support force at motor off reduces to a support force that is smaller than the self-weight-bearing support force.

In the present embodiment, the relationship between the spring torque and the knee angle θ1 is set such that the borne-by-leg-link support force at motor off changes relative to the knee angle θ1 as described above. The characteristic is implemented by appropriately setting the relationship between the pivot pin phase angle θ3 and the knee angle θ1. For example, the characteristic indicated by the curve a5 in FIG. 15 can be implemented by setting the relationship between the angle θ3 and the angle θ1 such that the difference between the angle θ4 (=θ3+α) shown in FIG. 5 and the angle θ1 is a predetermined value (e.g., 45 degrees).

Supplementally, in the present embodiment, the flexion degree of the leg link 3 corresponding to an arbitrary knee angle θ1 of the spring constant change angle θ1*c* or less corresponds to the first flexion degree in the present invention. The posture of the leg link 3 at a flexion degree obtained at θ1≦θ1*c* corresponds to the predetermined posture in the present invention. The state wherein the relationship θ1≦θ1*c* holds with both legs evenly in contact with the ground corresponds to the reference state in the present invention. The flexion degree of the leg link 3 at which the knee angle θ1 agrees with the predetermined angle θ1*d* corresponds to the second flexion degree in the present invention.

The walking assistance device in the present embodiment is the same as the walking assistance device A in the first embodiment except for the aspects described above. However, regarding the control processing by the controller 51, newly identified values for the walking assistance device of the present embodiment are used as the values of the coefficients A1, A2, A3, A4, and A5 in expression (6) given above and the values of the coefficients B1, B2, B3, B4, and B5 in expression (7). Similarly, in the processing by the torque converter 74*a* of the command current determiner 74, the arithmetic expression or the data table, namely, the arithmetic expression or the data table indicating the relationship between the knee angle and the effective radius length, used for determining the actual joint torque Tact from the rod transmission force measurement value Frod are newly set for the walking assistance device of the present embodiment.

In the walking assistance device of the present embodiment, the spring constant of the coil spring 40 changes in two steps according to the knee angle θ1. This allows the following advantage to be provided in addition to the advantages provided by the walking assistance device A of the first embodiment. More specifically, the range of the knee angle θ1 of both leg links 3 and 3 that allows the borne-by-leg-link support force at motor off to substantially agree with the self-weight-bearing support force (the range of θ1*c* or less) in the state wherein both legs are evenly in contact with the ground can be expanded to be wider than that in the walking assistance device A of the first embodiment. This provides a relatively wide range of the knee angle θ1 of the leg links 3 and 3 that is appropriate for preventing the seating portion 1 from falling when the operation of the electric motors 16 and 16 is stopped after using the walking assistance device. Thus, the user can stop the operation of the electric motors 16 and 16 without paying much attention to the knee angles θ1 of the leg links 3 and 3. It is possible, therefore, to improve the user-friendliness of the walking assistance device.

Moreover, the borne-by-leg-link support force at motor off can be set to be sufficiently larger than the self-weight-bearing support force in the case where the knee angles θ1 of both leg links 3 and 3 lie within a range wherein the borne-by-leg-link support force at motor off is larger than the self-weight-bearing support force (the range defined by θ1*c*<θ1<θ1*d*). In addition, an upper limit knee angle θ1*d* at which the borne-by-leg-link support force at motor off is larger than the self-weight-bearing support force can be brought closest to the maximum angle in the variable range of the knee angle θ1. This makes it possible to further reduce the maximum value of the output torque required of the electric motor 16. Consequently, the electric motor 16 can be made further smaller and lighter. Since the output torque of the electric motor 16 can be restrained to be small, the power consumption of the electric motor 16 can be further reduced.

Third Embodiment

Figure 16:
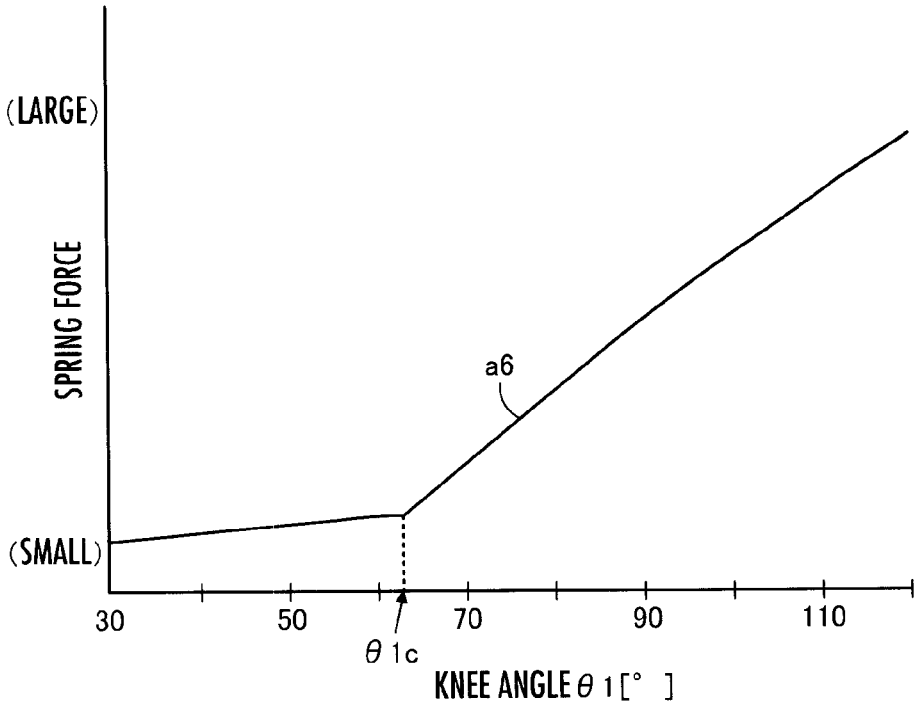
FIG. 16 is a graph illustrating the characteristic of an elastic member (coil spring) of a walking assistance device in a third embodiment.

A third embodiment of the present invention will now be described with reference to FIG. 16 and FIG. 17. The present embodiment differs from the second embodiment only in the characteristic related to the elastic member, so that the description will be focused on the different aspect. The like functional parts as those of the second embodiment will be assigned the like reference numerals as those in the second embodiment and the descriptions thereof will be omitted.

In the present embodiment, the coil spring 40 of each of toe leg links 3 has a low-spring-constant portion 40*a* and a high-spring-constant portion 40*b*, which have different spring constants, as with the second embodiment. Hence, the spring constant of the coil spring 40 changes in two steps according to the compression amount of the coil spring 40. The coil spring 40 is installed to an upper link member 5 of each of the leg links 3 in the same manner as that in the first embodiment and the second embodiment. The spring force of the coil spring 40 of each of the leg links 3 in the present embodiment changes as indicated by a curve a6 in FIG. 16 in relation to the knee angle θ1.

More specifically, as with the second embodiment, in the case where the knee angle θ1 is a predetermined spring constant change angle θ1*c* or less, the spring force slowly increases as the angle θ1 increases. Then, when the knee angle θ1 exceeds the spring constant change angle θ1*c*, i.e., when the compression amount of the coil spring 40 reaches a compression amount in a second compression range, the spring force increases as the angle θ1 increases at a larger incremental steps than those in the case where the relationship θ1≦θ1*c* holds.

In this case, the spring constant change angle θ1*c* is the same as with the second embodiment and approximately the same as a maximum knee angle implemented when a user walks on a level ground. In the present embodiment, however, the spring constant of the high-spring-constant portion 40*b* is set to be larger than that in the second embodiment. Hence, the spring force in the case where the relationship θ1≦θ1*c* holds increases at a larger incremental step than that in the second embodiment. In the following description of the present embodiment, "the coil spring 40" will mean a coil spring in the present embodiment having the characteristic described above unless otherwise specified.

Figure 17:
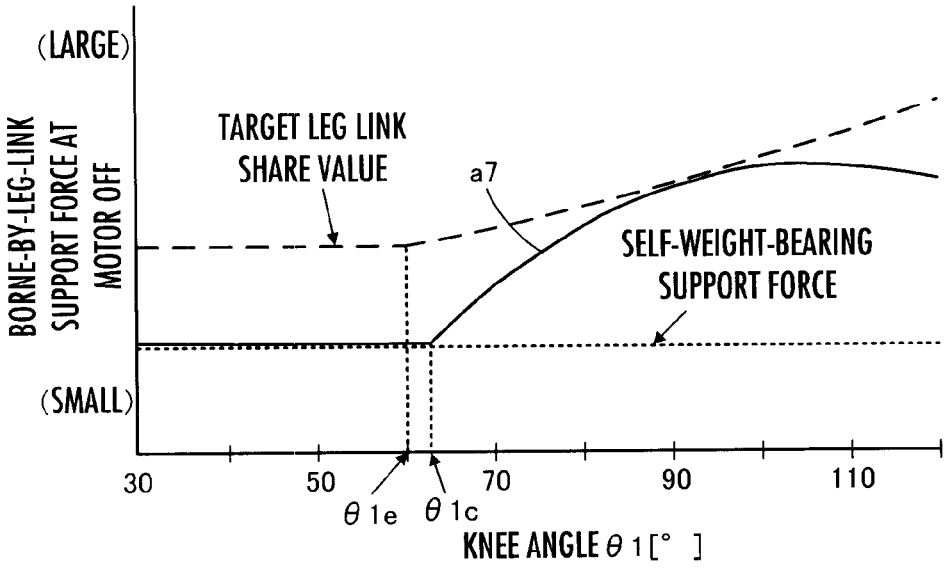
FIG. 17 is a graph illustrating the characteristic of the leg link bearing support force when a motor of the walking assistance device in the third embodiment stops.

In the present embodiment, the characteristic of the spring torque relative to the knee angle θ1 in each of the leg links 3 is set such that the borne-by-leg-link support force at motor off changes as indicated by a curve a7 in FIG. 17 in relation to the knee angles θ1 of both leg links 3 and 3 in the state wherein both legs are evenly in contact with the ground at motor off.

The characteristic indicated by the curve a7 in FIG. 17 has approximately the same trend as that in the second embodiment. More specifically, in the case where the relationship θ1≦θ1*c* holds, the borne-by-leg-link support force at motor off is maintained at a support force having a magnitude substantially equal to that of the self-weight-bearing support force. In the case where the relationship θ1>θ1*c* applies, as the knee angle θ1 increases, the borne-by-leg-link support force at motor off increases to a support force that is larger than the self-weight-bearing support force and then decreases. In the present embodiment, in the case where θ1>θ1*c* holds, the borne-by-leg-link support force at motor off is always larger than the self-weight-bearing support force.

In the present embodiment, the relationship between the spring torque and the knee angle θ1 is set such that the borne-by-leg-link support force at motor off changes in relation to the knee angle θ1 as described above. The characteristic is implemented by appropriately setting the relationship between the pivot pin phase angle θ3 and the knee angle θ1. For example, the characteristic indicated by the curve a7 in FIG. 17 can be implemented by setting the relationship between the angle θ3 and the angle θ1 such that the difference between the angle θ4 (=74 3+α) shown in FIG. 5 and θ1 is a predetermined value (e.g., 5 degrees).

Here, in the present embodiment, the same control processing as the control processing by the controller 51 described in the first embodiment is carried out. Hence, a target leg link share value Fcmd of each of the leg links 3 in the state wherein both legs are evenly in contact with the ground changes according to the knee angles θ1 of both leg links 3 and 3 (provided that the knee angles θ1 of both leg links 3 and 3 are the same), as indicated by the dashed line in FIG. 17.

More specifically, in the case where the knee angle θ1 is a predetermined value θ1*e* or less, the target leg link share value Fcmd will be a fixed value (a value that is half the target value of the total lifting force). The predetermined value θ1*e* indicates the value of the knee angle θ1 when the distance D3 (the distance D3 between the curvature center 4*a*R and the second joint 6R) of the right side of expression (4a) given above equals a reference value DS3, i.e., an angle that is approximately the same as the maximum knee angle of each of the leg links 3 implemented when a user is in a normal walking mode on a level ground. Accordingly, the predetermined value θ1*e* indicates an angle approximately equal to the spring constant change angle θ1*c*.

In this case, the target leg link share value Fcmd will be a support force that is larger than the self-weight-bearing support force by the half of a lifting force to be applied from the seating portion 1 to the user, i.e., the lifting force share per leg link 3.

When the angle θ1 exceeds the predetermined value θ1*e*, the addition of the restoring support force determined by expression (4a) given above to the target leg link share value Fcmd causes the target leg link share value Fcmd to increase as the angle θ1 increases. In this case, the target leg link share value Fcmd will be larger than a value in the case where the relationship θ1≦θe holds by the adder restoring support force. The characteristic of changes in the target leg link share value Fcmd in the state wherein both legs are evenly in contact with the ground is the same as that in the first embodiment and the second embodiment.

In the present embodiment, the angle θ1*e* is slightly smaller than θ1*c*; alternatively however, the angle θ1*e* may be equal the angle θ1*c* (θ1*e*=θ1*c*).

Further, in the present embodiment, the spring constant of the high-spring-constant portion 40*b*, i.e., the spring constant of the coil spring 40 in the second compression range, is set such that the borne-by-leg-link support force at motor off in the case where the relationship θ1>θ1*e* applies takes a value that is close to a target leg link share value as much as possible. In the illustrated example, the spring constant has been set such that the difference between the borne-by-leg-link support force at motor off and the target leg link share value becomes extremely small within the range of 80° to 110°.

Supplementally, in the present embodiment, the flexion degree of the leg link 3 corresponding to an arbitrary knee angle θ1 of the spring constant change angle θ1*c* or less corresponds to the first flexion degree in the present invention. The posture of the leg link 3 at a flexion degree obtained when the relationship θ1≦θc applies corresponds to the predetermined posture in the present invention. The state wherein the relationship θ1≦θc applies with both legs evenly in contact with the ground corresponds to the reference state in the present invention.

The walking assistance device in the present embodiment is the same as the walking assistance devices in the first embodiment and the second embodiment except for the aspects described above. However, regarding the control processing by the controller 51, newly identified values for the walking assistance device of the present embodiment are used as the values of the coefficients A1, A1, A3, A4, and A5 in expression (6) given above and the values of the coefficients B1, B2, B3, B4, and B5 in expression (7). Similarly, in the processing by the torque converter 74*a* of the command current determiner 74, the arithmetic expression or the data table, namely, the arithmetic expression or the data table indicating the relationship between the knee angle and the effective radius length, used for determining the actual joint torque Tact from the rod transmission force measurement value Frod are newly set for the walking assistance device of the present embodiment.

The walking assistance device according to the present embodiment enables the borne-by-leg-link support force at motor off to substantially agree with the self-weight-bearing support force, as with the second embodiment, in the case where the knee angles θ1 of both leg links 3 and 3 are θ1*c* or less in the state wherein both legs are evenly in contact with the ground. This state allows the operation of the electric motors 16 and 16 to be stopped without causing the seating portion 1 to fall. Thus, the same advantages as those of the first embodiment and the second embodiment can be achieved.

Meanwhile, the spring torque is set such that the borne-by-Leg-link support force at motor off becomes closest to the target leg link share value Fcmd in the range of the knee angle θ1 wherein the relationship θ1≦θ1*c* applies is the state in which both legs evenly in contact with the ground. This makes it possible to further reduce the maximum output torque of the electric motor 16, allowing the electric motor 16 to be made further smaller and lighter. In addition, the power consumption of the electric motor 16 can be further reduced accordingly.

The following will describe a few modifications of the embodiments described above. In the embodiments described above, the load transmit portion has been formed of the seating portion 1 having the saddle-shaped seat 1*a*. However, the load transmit portion may alternatively be formed of, for example, a harness-shaped flexible member having a portion to be in contact with the crotch of a user.

Further, in the embodiments described above, the first joint 4 has the arcuate guide rail 11, and the curvature center 4*a* of the guide rail 11 serving as a longitudinal swing support point of each of the leg links 3 is positioned above the seating portion 1. Alternatively, however, the first joint 4 may be formed of a simple joint structure in which, for example, the upper end portion of the leg link 3 is rotatably supported by a transverse (lateral) shaft at a side or bottom of the seating portion 1.

Further, to assist the walking of a user having a problem with one leg due to bone fracture or the like, only one of the right and the left leg links 3 and 3 in each of the embodiments, whichever leg the user is having a problem with, may be used and the other leg link may be omitted.

In the embodiments described above, the third joint 8 of each of the leg links 3 is a rotary joint for the leg link 3 to bend and stretch. Alternatively, however, the third joint 8 may be formed of, for example, a linear-motion type joint.

Further, in the embodiments described above, the linear-motion actuator 14 has the electric motor 16 and the ball screw mechanism. Alternatively, however, a linear-motion actuator using a cylinder may be used. Further, the drive mechanism may be constructed to transmit the rotational drive force output from the electric motor to the third joint 8 via a wire. Alternatively, the rotational drive force of the electric motor may be transmitted to the third joint 8 through the intermediary of a pair of crank arms connected through a rod. Further, a rotating actuator, such as an electric motor, may be installed concentrically with the joint axis of the third joint 3 to directly impart the rotational drive force of the rotating actuator to the third joint 8.

In the embodiments described above, the elastic member has been constructed of the coil spring 40. Alternatively, however, the elastic member may be formed of an air spring having an air chamber, the volume of which changes according as the leg link bends or stretches (e.g., a pair of air chambers defined by a piston in a cylinder tube). In this case, for example, an air passage in communication with the air chamber may be provided with a variable aperture, and the opening area of the variable aperture may be changed according to the flexion degree of the leg link 3. This makes it possible to change the spring constant of the air spring.

In the embodiments described above, the spring constant of the coil spring 40 functioning as the elastic member has been changed in two steps. Alternatively, however, the coil spring may be constructed such that the spring constant is changed in three steps or more.

In the embodiments described above, the torque imparted to the third joint 8 has been the amount to be controlled in the present invention. Alternatively, however, the rod transmission force defines the torque to be imparted to the third joint 8, so that the rod transmission force may be used as the amount to be controlled in the present invention. In this case, the target value of the rod transmission force corresponding to the target value of the torque to be imparted to the third joint 3 may be set and the output torque of the electric motor 16 may be controlled such that the rod transmission force measurement value Frod agrees with the set target value.

What is claimed is:

1. A walking assistance comprising:

a load transmit portion which transmits load for supporting a part of the weight of a user to a body trunk of the user;

a foot-worn portion to be attached to a foot of the user, a leg link which connects the foot-worn portion to the load transmit portion, the leg link including an upper link member extended from the load transmit portion through the intermediary of a first joint, a lower link member extended from the foot-worn portion through the intermediary of a second joint, and a third joint bendably connecting the upper link member and the lower link member; and a drive mechanism which includes an actuator and transmits the motive power output from the actuator to the third joint so as to drive the third joint, wherein the leg link is provided with an elastic member which imparts, to the third joint, an urging torque for restraining a flexion degree of the leg link from changing from a first flexion degree due to gravity acting on the walking assistance device in a reference state wherein at least the foot-worn portion is in contact with a ground and the flexion degree of the leg link at the third joint is a predetermined first flexion degree, wherein the flexion degree of the leg link can be changed in a predetermined variable range including the flexion degree in a state wherein the user is in an upright posture, and the first flexion degree is a flexion degree which is closer to the flexion degree in the state wherein the user is in the upright posture than a maximum flexion degree in the variable range, and wherein the urging torque to be imparted to the third joint by the elastic member is set such that the resultant torque of a torque which acts on the third joint due to the gravity acting on the walking assistance device in a state wherein at least the flexion degree of the leg link becomes the maximum flexion degree in the variable range and the urging torque becomes a torque in the flexing direction of the leg link.

2. The walking assistance device according to claim 1, wherein the elastic member has a characteristic in which the change rate of an elastic force with respect to a change in an elastic deformation amount thereof changes with the elastic deformation amount.

3. A walking assistance device comprising:

a load transmit portion which transmits load for supporting a part of the weight of a user to a body trunk of the user;

a foot-worn portion to be attached to a foot of the user, a leg link which connects the foot-worn portion to the load transmit portion, the leg link including an upper link member extended from the load transmit portion through the intermediary of a first joint, a lower link member extended from the foot-worn portion through the intermediary of a second joint, and a third joint bendable connecting the upper link member and the lower link member; and a drive mechanism which includes an actuator and transmits the motive power output from the actuator to the third joint so as to drive the third joint, wherein the leg link is provided with an elastic member which imparts, to the third joint, an urging torque for restraining a flexion degree of the leg link from changing from a first flexion degree due to gravity acting on the walking assistance device in a reference state wherein at least the foot-worn portion is in contact with a ground and the flexion degree of the leg link at the third joint is a predetermined first flexion degree, wherein the flexion degree of the leg link can be changed in a predetermined variable range including the flexion degree in a state wherein the user is in an upright posture, and the first flexion degree is a flexion degree which is closer to the flexion degree in the state wherein the user is in the upright posture than a maximum flexion degree in the variable range, wherein the urging torque to be imparted by the elastic member to the third joint is set such that the resultant torque of a torque acting on the third joint due to the gravity acting on the walking assistance device and the urging torque becomes a torque in a stretching direction of the leg link in the case where the flexion degree of the leg link is a flexion degree that is larger than a predetermined second flexion degree in the variable range, and the first flexion degree is a flexion degree that is the second flexion degree or less.

4. The walking assistance device according to claim 3, wherein the elastic member has a characteristic in which the change rate of an elastic force with respect to a change in an elastic deformation amount thereof changes with the elastic deformation amount.

5. A walking assistance device comprising:

a load transmit portion which transmits load for supporting a part of the weight of a user to a body trunk of the user;

a foot-worn portion to be attached to a foot of the user, a leg link which connects the foot-worn portion to the load transmit portion, the leg link including an upper link member extended from the load transmit portion through the intermediary of a first joint, a lower link member extended from the foot-worn portion through the intermediary of a second joint, and a third joint bendable connecting the upper link member and the lower link member; and a drive mechanism which includes an actuator and transmits the motive power output from the actuator to the third joint so as to drive the third joint, wherein the leg link is provided with an elastic member which imparts, to the third joint, an urging torque for restraining a flexion degree of the leg link from changing from a first flexion degree due to gravity acting on the walking assistance device in a reference state wherein at least the foot-worn portion is in contact with a ground and the flexion degree of the leg link at the third joint is a predetermined first flexion degree, wherein the drive mechanism has a crank arm secured to the lower link member concentrically with the joint axis of the third joint and a linear-motion actuator, which has a linear-motion output shaft, one end thereof being connected to the crank arm, and which is installed to the upper link member such that the linear-motion actuator can swing about the axial center of a swing shaft parallel to the joint axis of the third joint, the drive mechanism is constructed so as to convert a translational force output from the linear-motion output shaft of the linear-motion actuator into a rotational driving force for the third joint through the intermediary of the crank arm, and the elastic member is composed of a coil spring that urges the linear-motion output shaft of the linear-motion actuator in the direction of the axial center thereof.

6. The walking assistance device according to claim 5, wherein the coil spring has a characteristic in which the change rate of the elastic force relative to a change in a compression amount of the coil spring differs between a first compression range in which the compression amount is a predetermined value or less and a second compression range in which the compression amount exceeds the predetermined value, and the change rate in the second compression range is larger than the change rate in the first compression range, and the coil spring is provided such that the coil spring is compressed as the linear-motion output shaft is displaced in a direction in which the flexion degree of the leg link increases.

7. The walking assistance device according to claim 5, wherein the linear-motion actuator is installed at a location adjacent to the first joint of the upper link member and the coil spring is disposed concentrically with the linear-motion output shaft between the linear-motion actuator and the third joint.

8. The walking assistance device according to claim 5, wherein the elastic member has a characteristic in which the change rate of an elastic force with respect to a change in an elastic deformation amount thereof changes with the elastic deformation amount.

* * * * *